US006918323B2

(12) United States Patent
Arnold et al.

(10) Patent No.: US 6,918,323 B2
(45) Date of Patent: Jul. 19, 2005

(54) REVERSIBLE RATCHETING TOOL WITH IMPROVED PAWL

(75) Inventors: Robert L. Arnold, Wrightsville, PA (US); Richard P. Folkenroth, York, PA (US)

(73) Assignee: Easco Hand Tools Inc., Simsbury, CT (US)

( * ) Notice: Subject to any disclaimer, the term of this patent is extended or adjusted under 35 U.S.C. 154(b) by 98 days.

(21) Appl. No.: 10/286,603

(22) Filed: Nov. 1, 2002

(65) Prior Publication Data

US 2004/0083860 A1 May 6, 2004

(51) Int. Cl.[7] ..... B25B 13/46
(52) U.S. Cl. ..... 81/63.2; 81/63; 81/63.1
(58) Field of Search ..... 81/63.2, 63, 63.1, 81/62, 57.39, 58.4

(56) References Cited

U.S. PATENT DOCUMENTS

| | | | | |
|---|---|---|---|---|
| 878,657 | A | 2/1908 | Munch | |
| 1,090,578 | A | 3/1914 | Smythe | |
| 2,701,977 | A | 2/1955 | Stone | 81/63.2 |
| 2,725,772 | A | 12/1955 | Stone | 81/63 |
| 2,957,377 | A | 10/1960 | Hare | 81/63.2 |
| 3,436,992 | A | 4/1969 | Over et al. | 81/63.1 |
| 3,606,940 | A | 9/1971 | Finkeldei | 192/43.1 |
| 3,783,703 | A | 1/1974 | Trimble et al. | 74/157 |
| 3,866,492 | A | 2/1975 | Knoll | 81/52.4 |
| 4,257,507 | A | 3/1981 | Solomon | 192/43.1 |
| 4,497,227 | A | 2/1985 | Stasiek | 81/63.1 |
| 4,520,697 | A | 6/1985 | Moetteli | 81/62 |
| 4,762,033 | A | 8/1988 | Chow | 81/63.2 |
| 4,924,737 | A | 5/1990 | Gummow | 81/63.2 |
| 5,404,773 | A | 4/1995 | Norville | 81/63.1 |
| 5,448,931 | A | 9/1995 | Fossella et al. | 81/63.2 |
| 5,467,672 | A | 11/1995 | Ashby | 81/58.2 |
| 5,495,783 | A | 3/1996 | Slusar et al. | 81/63.2 |
| 5,501,124 | A | 3/1996 | Ashby | 81/58.2 |
| 5,535,646 | A | 7/1996 | Allen et al. | 81/57.39 |
| 5,884,537 | A | 3/1999 | Chen | 81/58.4 |
| 6,044,731 | A | 4/2000 | Hsieh | 81/63.2 |
| 6,155,140 | A * | 12/2000 | Tsai | 81/61 |
| 6,216,563 | B1 | 4/2001 | Hsieh | 81/63.2 |
| 6,230,591 | B1 * | 5/2001 | Ling et al. | 81/63 |
| 6,282,992 | B1 | 9/2001 | Hu | 81/63.2 |
| 6,431,030 | B1 | 8/2002 | Kuo et al. | 81/63 |
| 6,435,063 | B1 | 8/2002 | Chen | 81/63.2 |
| 6,450,066 | B1 * | 9/2002 | Hu | 81/60 |
| 6,457,387 | B1 | 10/2002 | Hu | 81/63.2 |
| 6,457,388 | B1 | 10/2002 | Chen | 81/63.2 |
| 2001/0054531 | A1 | 12/2001 | Chang | 192/42 |
| 2002/0084163 | A1 | 7/2002 | Chen | 192/43 |
| 2002/0112573 | A1 | 8/2002 | Hu | 81/63.2 |
| 2002/0166416 | A1 | 11/2002 | Hu | 81/63.2 |

FOREIGN PATENT DOCUMENTS

| | | |
|---|---|---|
| DE | 1 603 905 | 6/1971 |

* cited by examiner

*Primary Examiner*—Joseph J. Hail, III
*Assistant Examiner*—Alvin J Grant
(74) *Attorney, Agent, or Firm*—Nelson Mullins Riley & Scarborough, L.L.P.

(57) ABSTRACT

A ratcheting tool includes a body and a gear disposed in the body. The gear defines a plurality of teeth on a circumference of the gear so that the gear teeth define a first arc having a first radius. A pawl is disposed in the body so that the pawl is movable laterally with respect to the gear between a first position, in which the pawl is disposed between the body and the gear so that the body transmits torque through the pawl in a first rotational direction, and a second position, in which the pawl is disposed between the body and the gear so that the body transmits torque through the pawl in an opposite rotational direction. The pawl defines a plurality of teeth facing the gear, and the pawl teeth define a second arc having a second radius larger than the first radius.

25 Claims, 21 Drawing Sheets

REVERSIBLE RATCHETING TOOL WITH IMPROVED PAWL

BACKGROUND OF THE INVENTION

Ratcheting tools, for example ratchets and wrenches, often include a generally cylindrical ratchet gear and a pawl that controls the gear's ratcheting direction so that the gear may rotate in one direction but is prevented from rotation in the other. It is known to dispose the pawl so that it engages teeth either on the gear's inner or outer diameter. Examples of ratcheting tools having a sliding pawl engaging the outer diameter of a ratchet gear are provided in U.S. Pat. Nos. 6,230,591 and 5,636,557, the entire disclosure of each of which is incorporated by reference herein.

SUMMARY OF THE INVENTION

The present invention recognizes and addresses considerations of prior art constructions and methods.

In one embodiment of a ratcheting tool according to the present invention, a ratcheting tool includes a body and a gear disposed in the body. The gear defines a plurality of teeth on a circumference of the gear so that the gear teeth define a first arc having a first radius. A pawl is disposed in the body so that the pawl is movable laterally with respect to the gear between a first position, in which the pawl is disposed between the body and the gear so that the body transmits torque through the pawl in a first rotational direction, and a second position, in which the pawl is disposed between the body and the gear so that the body transmits torque through the pawl in an opposite rotational direction. The pawl defines a plurality of teeth facing the gear, and the pawl teeth define a second arc having a second radius larger than the first radius.

The accompanying drawings, which are incorporated in and constitute a part of this specification, illustrate one or more embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended drawings, in which.

Figure 1:
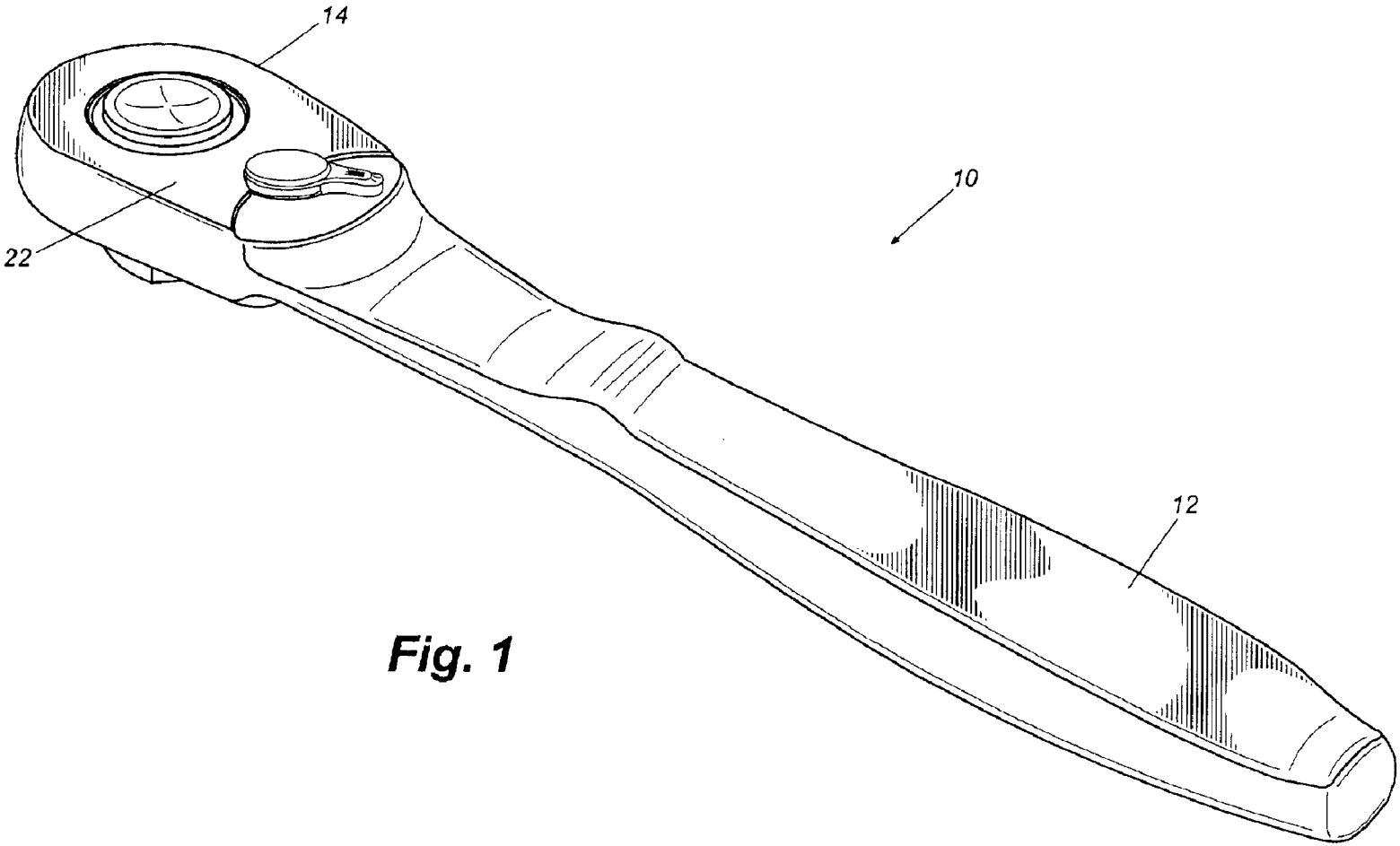
FIG. 1 is a perspective view of a ratcheting tool in accordance with an embodiment of the present invention.
Figure 4A:
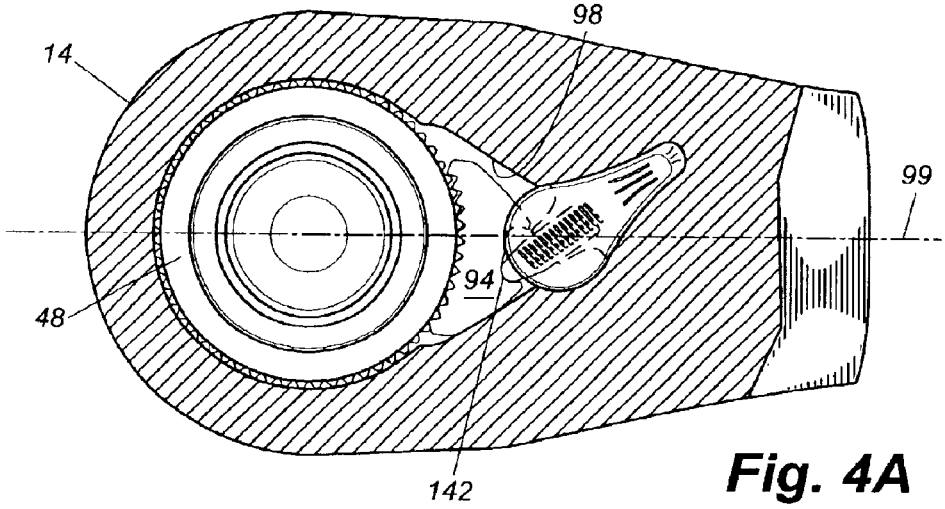
Figure 4B:
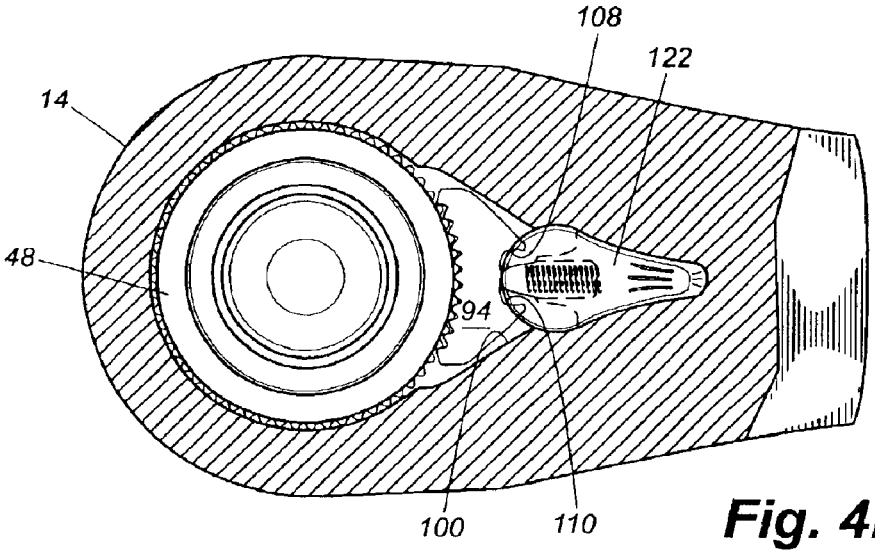
Figure 4C:
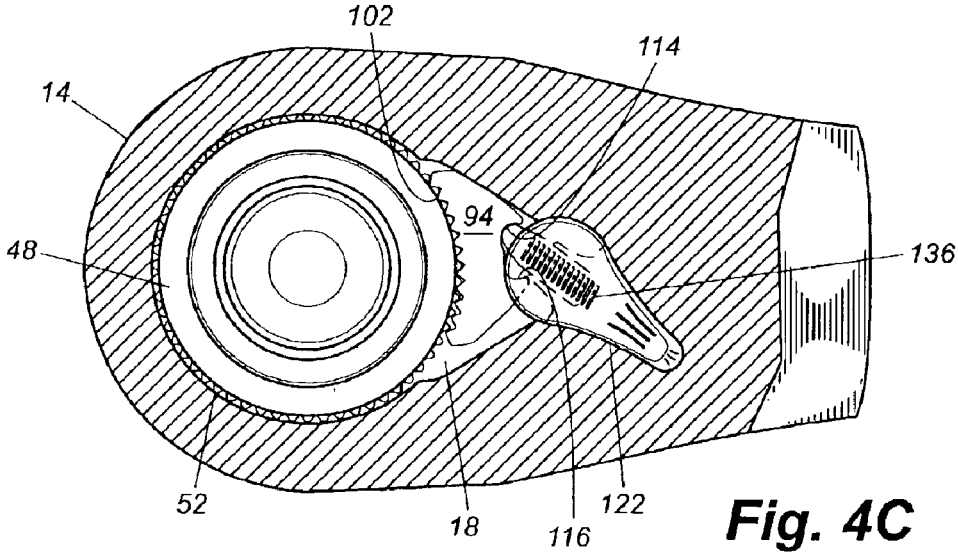
Figure 5A:
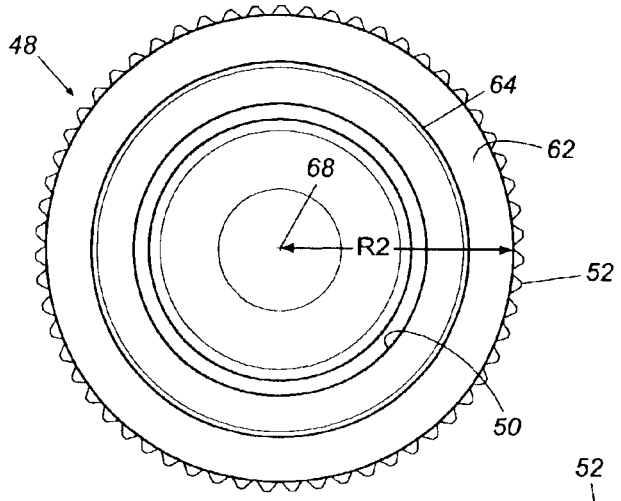
Figure 5B:
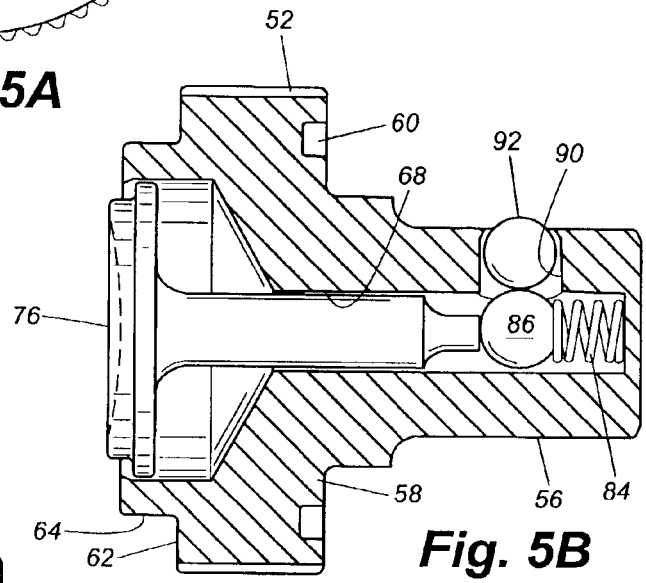
Figure 5C:
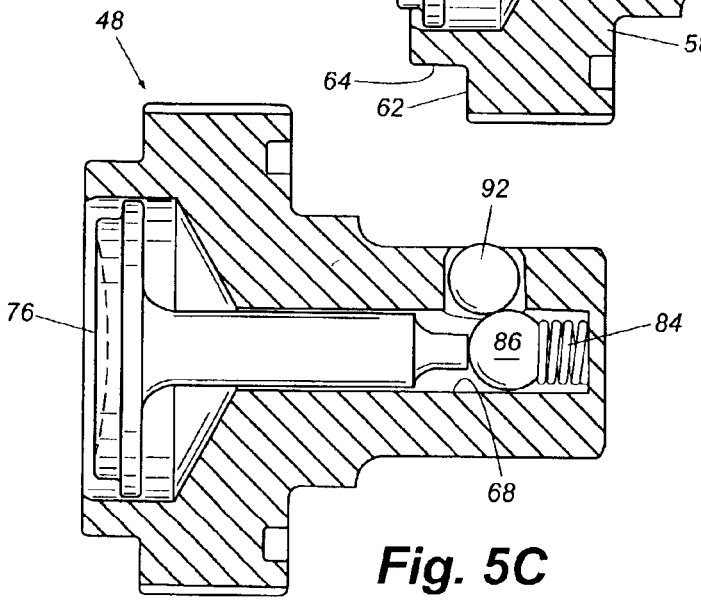
Figure 6:
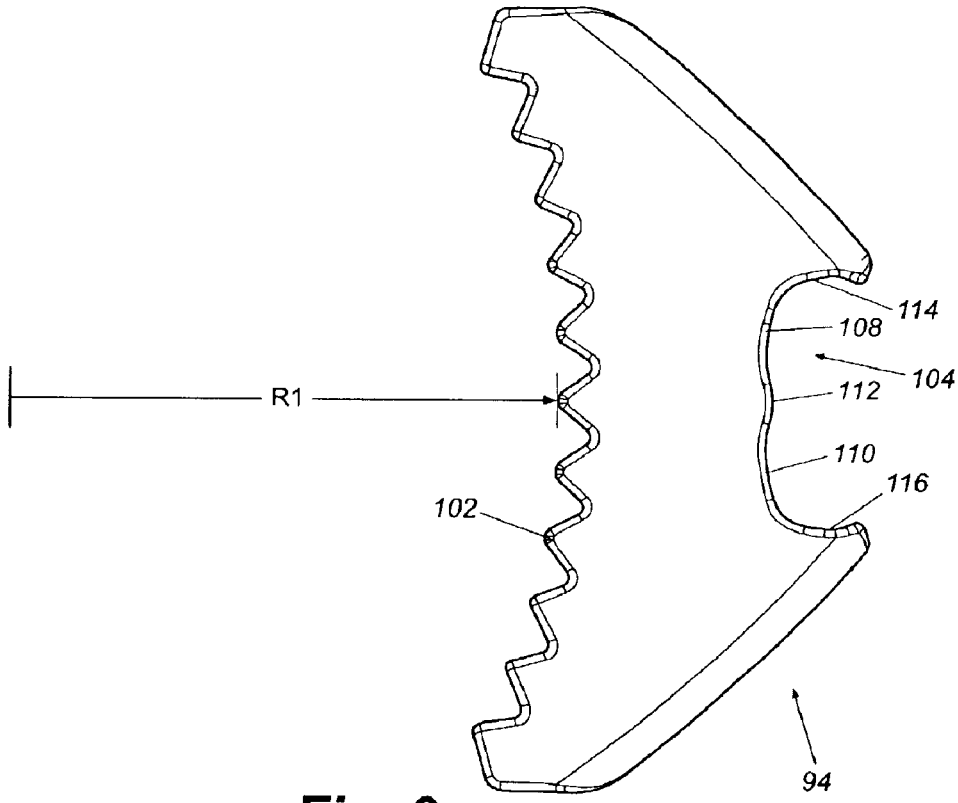
Figure 7:
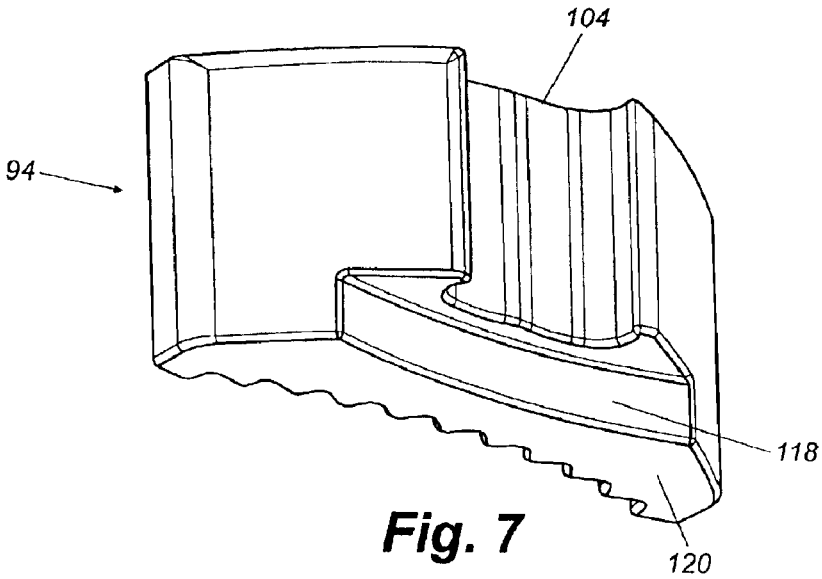
Figure 8:
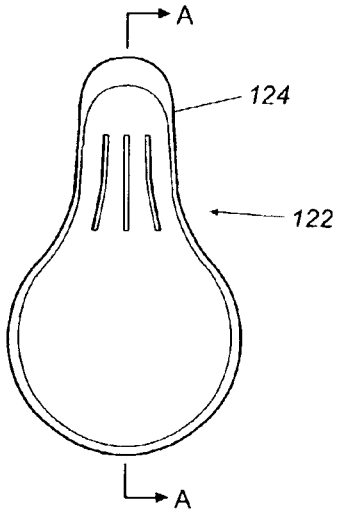
Figure 9:
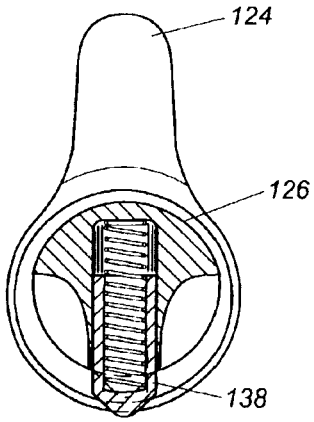
Figure 8A:
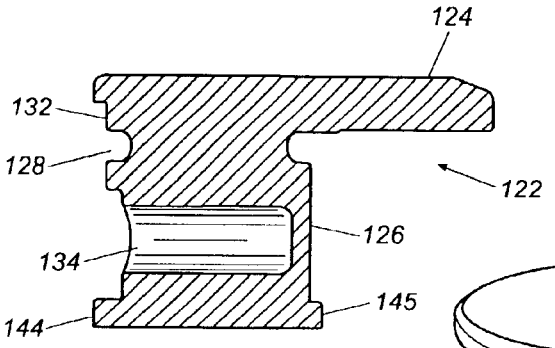
Figure 10:
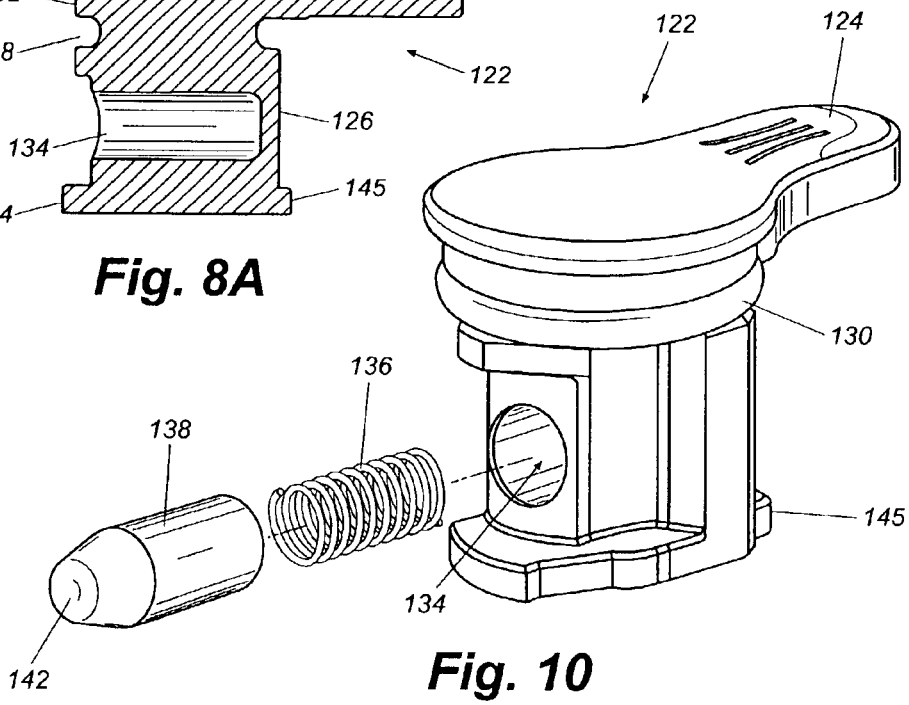
Figure 11:
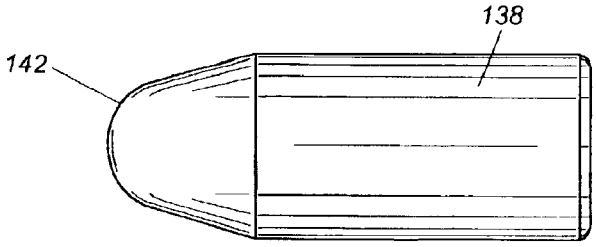
Figure 11A:
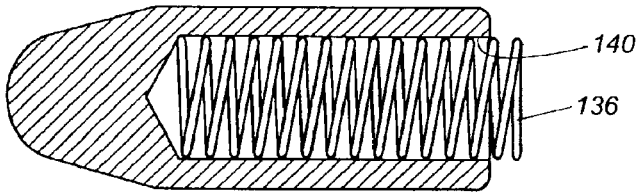
Figure 12:
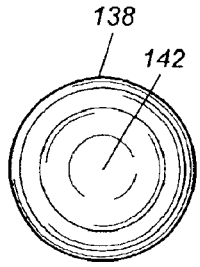
Figure 13:
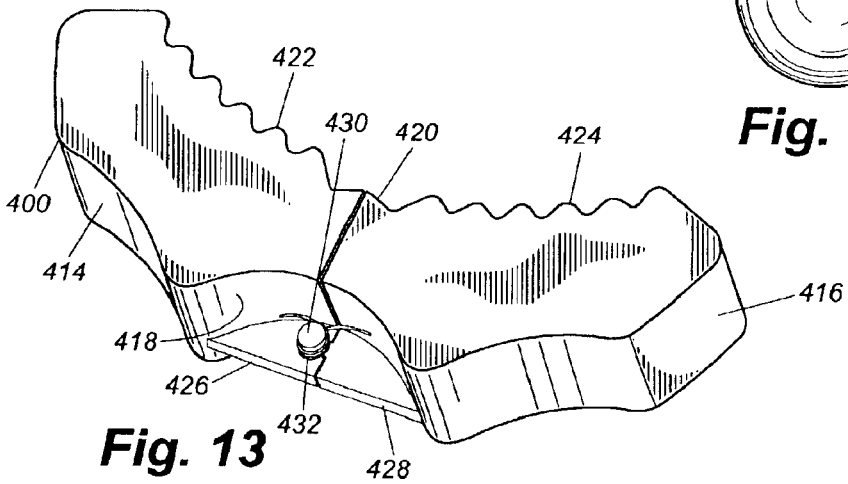
Figure 13A:
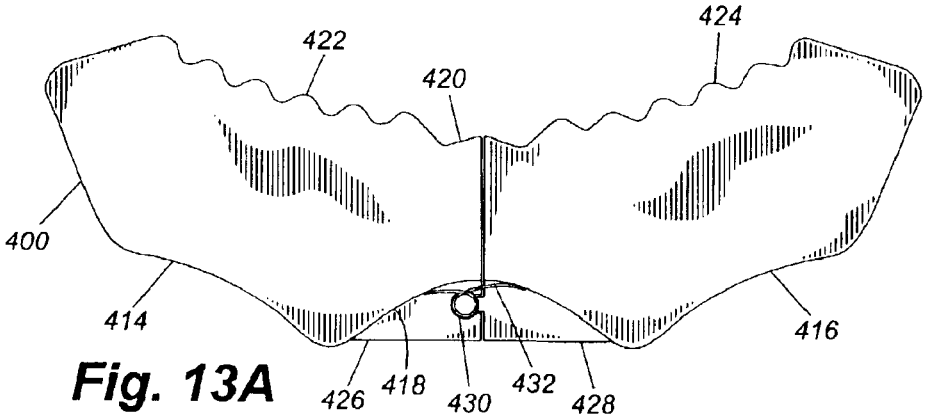
Figure 14A:
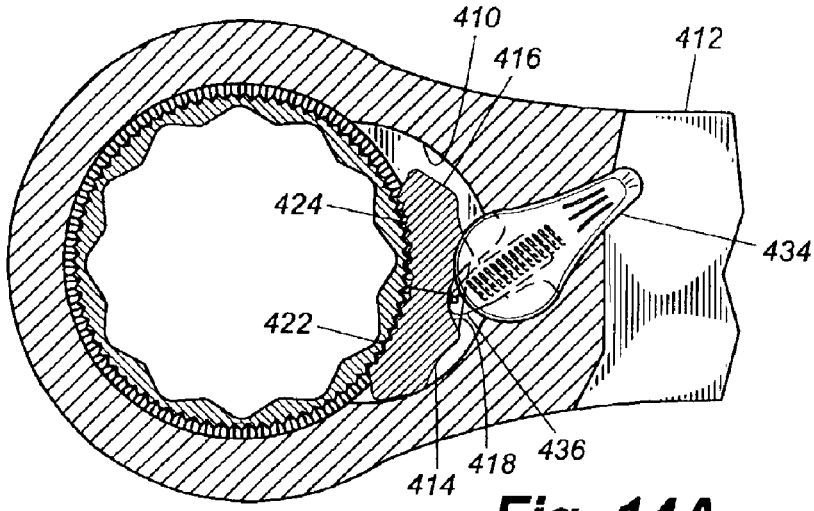
Figure 14B:
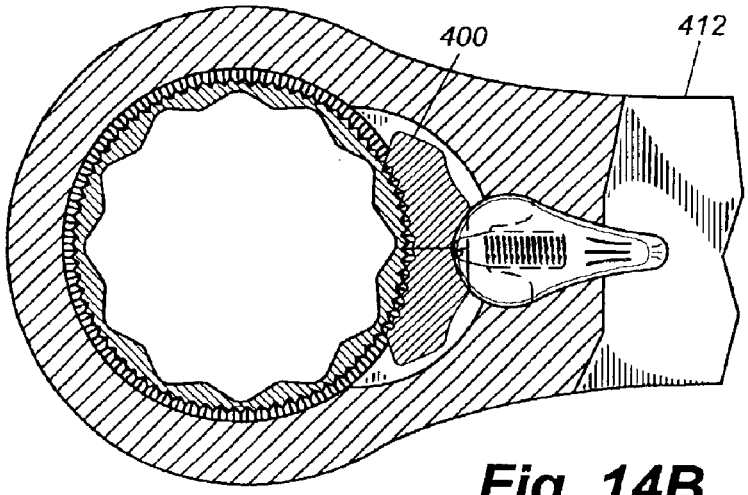
Figure 14C:
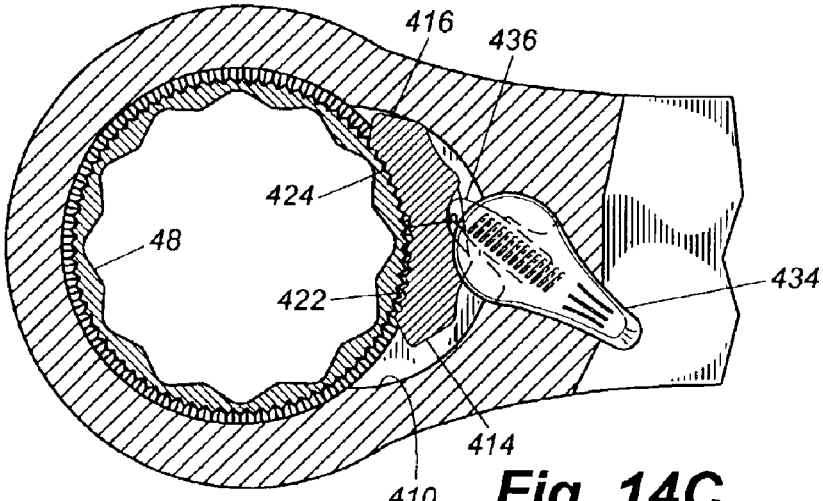
Figure 15A:
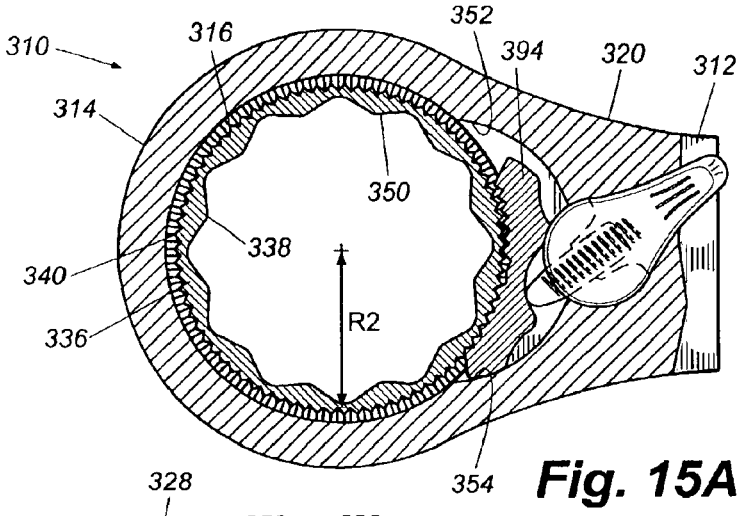
Figure 15B:
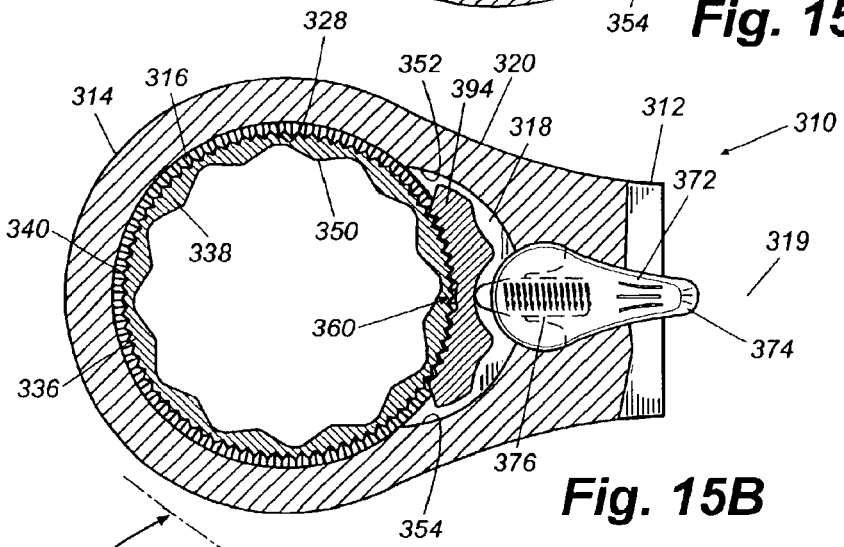
Figure 15C:
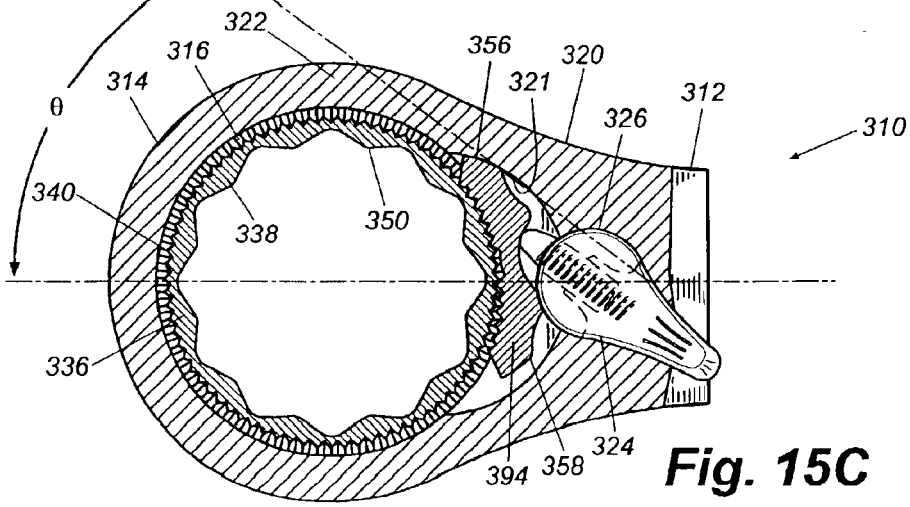
Figure 15D:
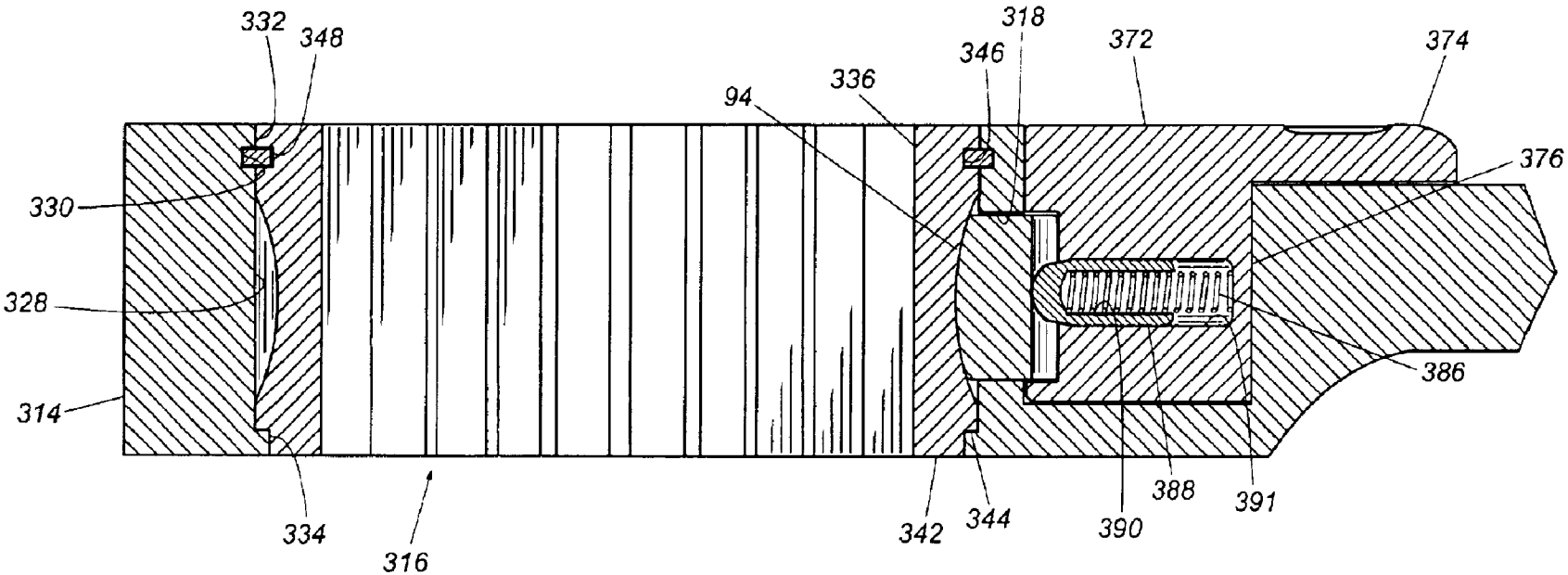
Figure 15E:
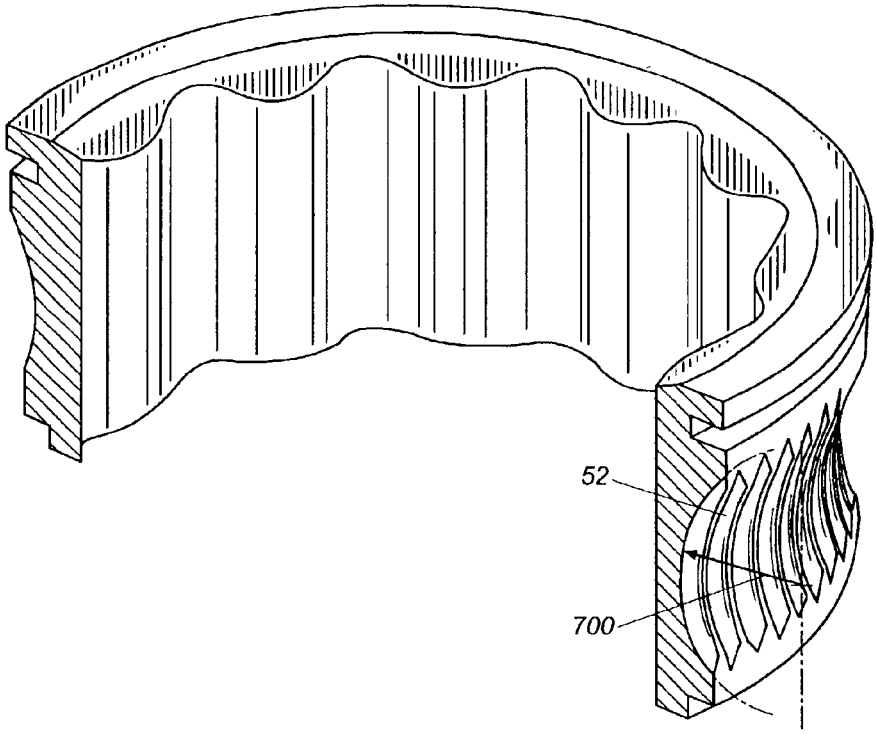
Figure 15F:
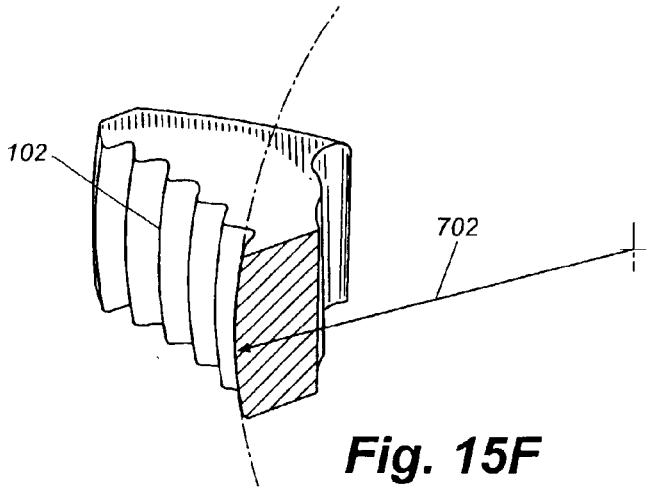
Figure 16A:
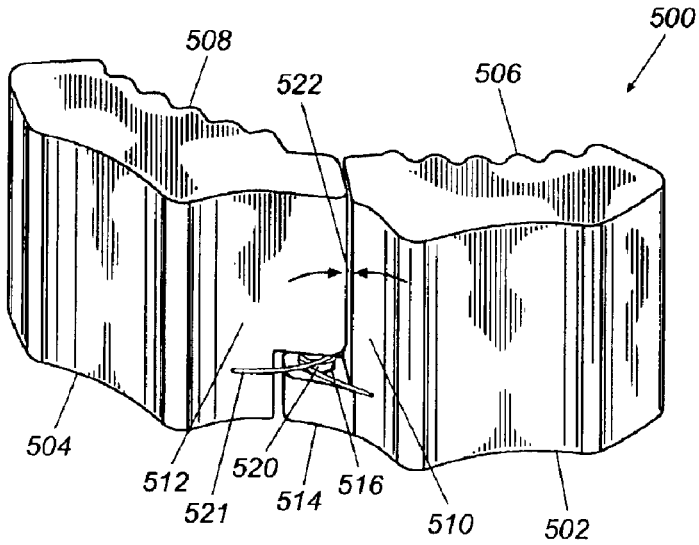
Figure 16B:
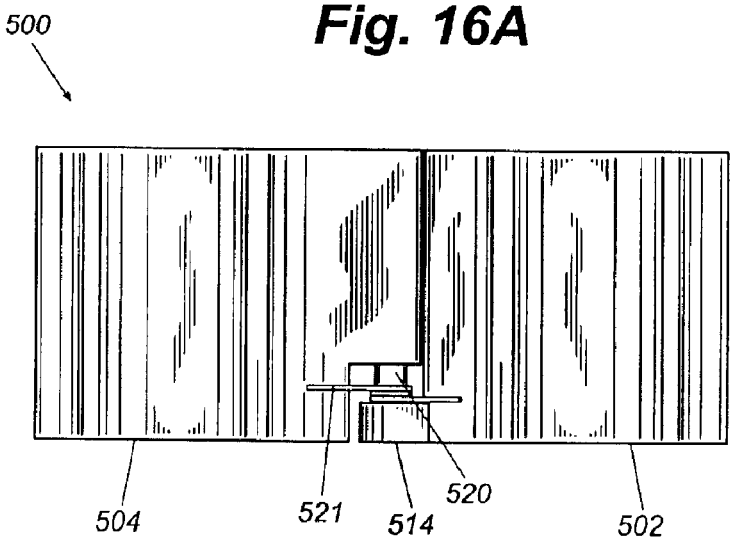
Figure 16C:
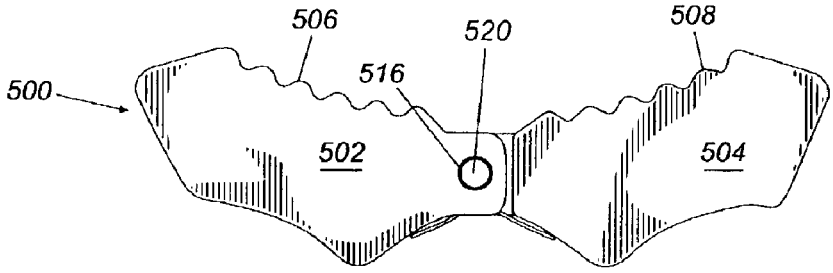
Figure 17:
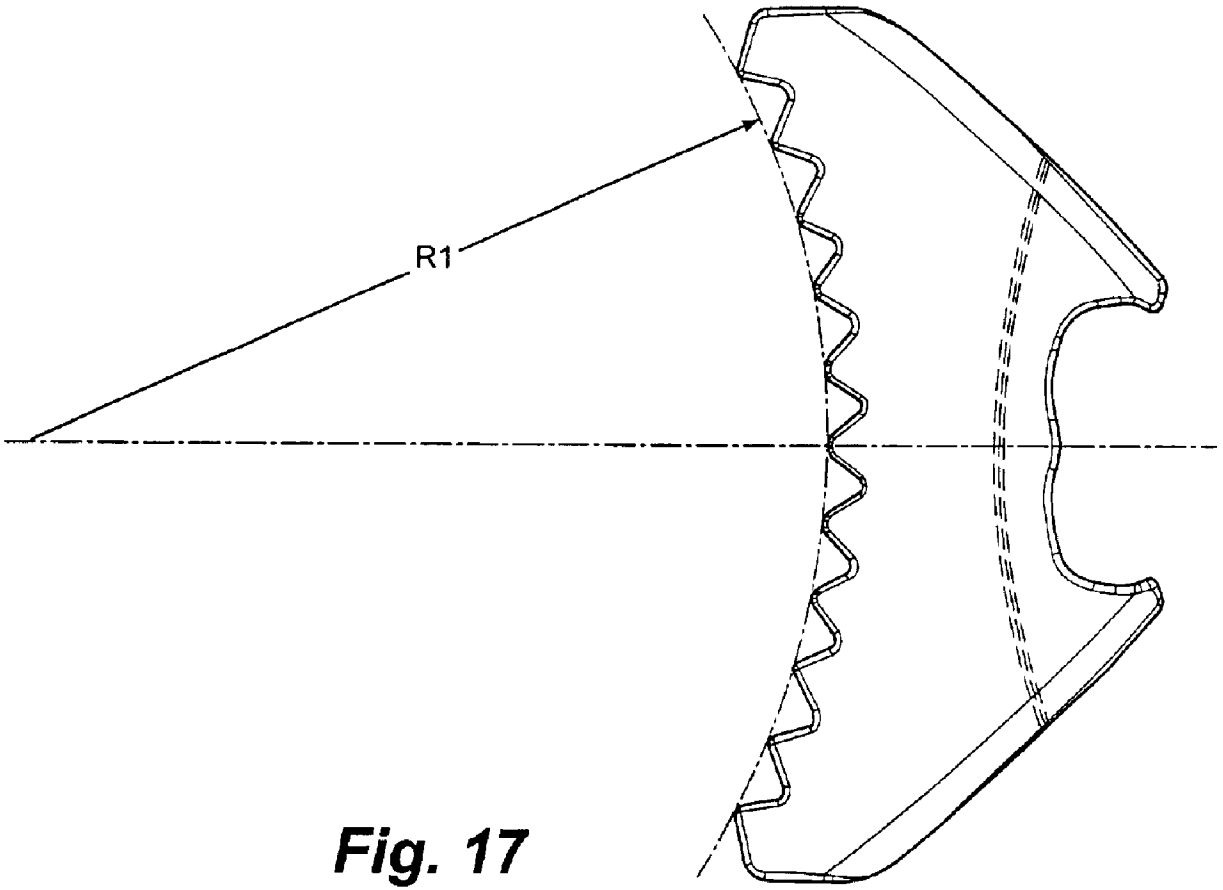
Figure 18:
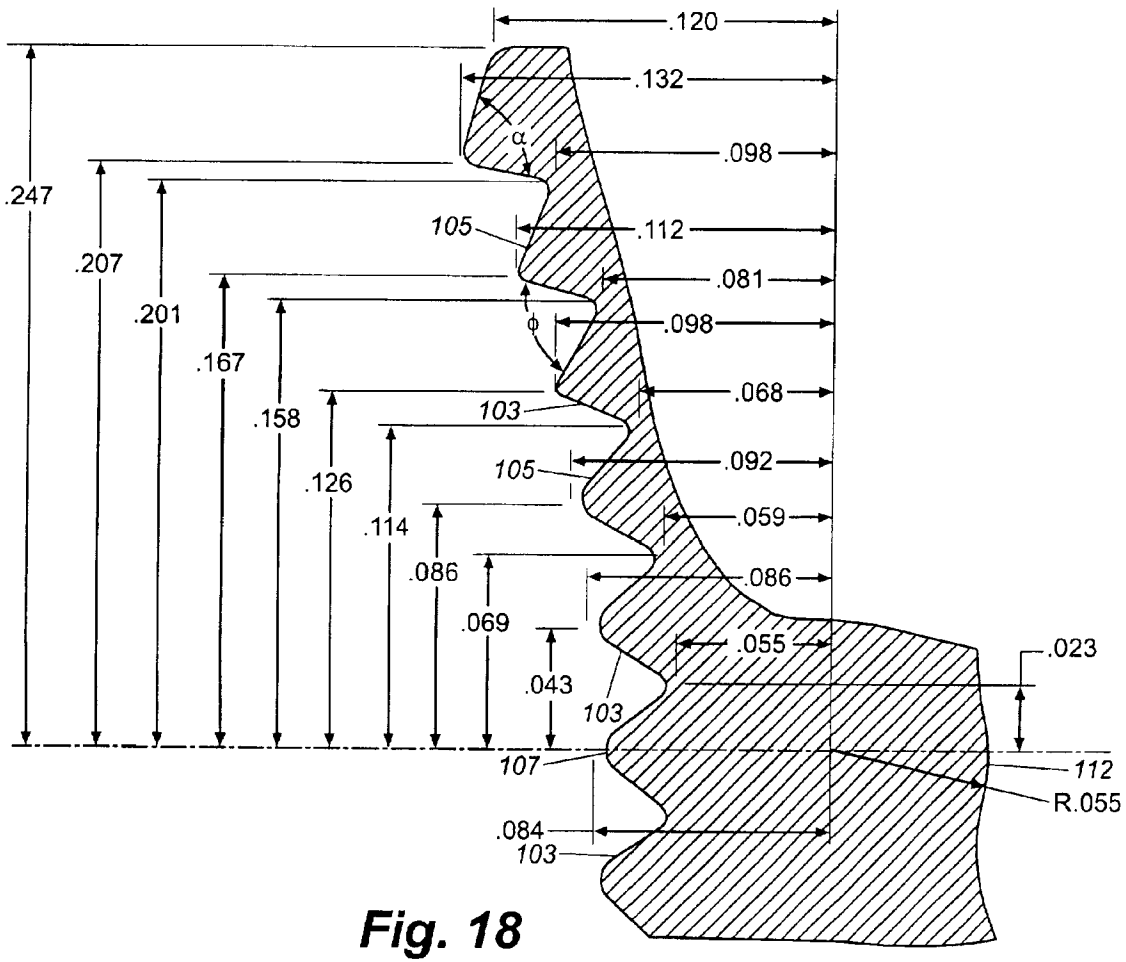
Figure 19:
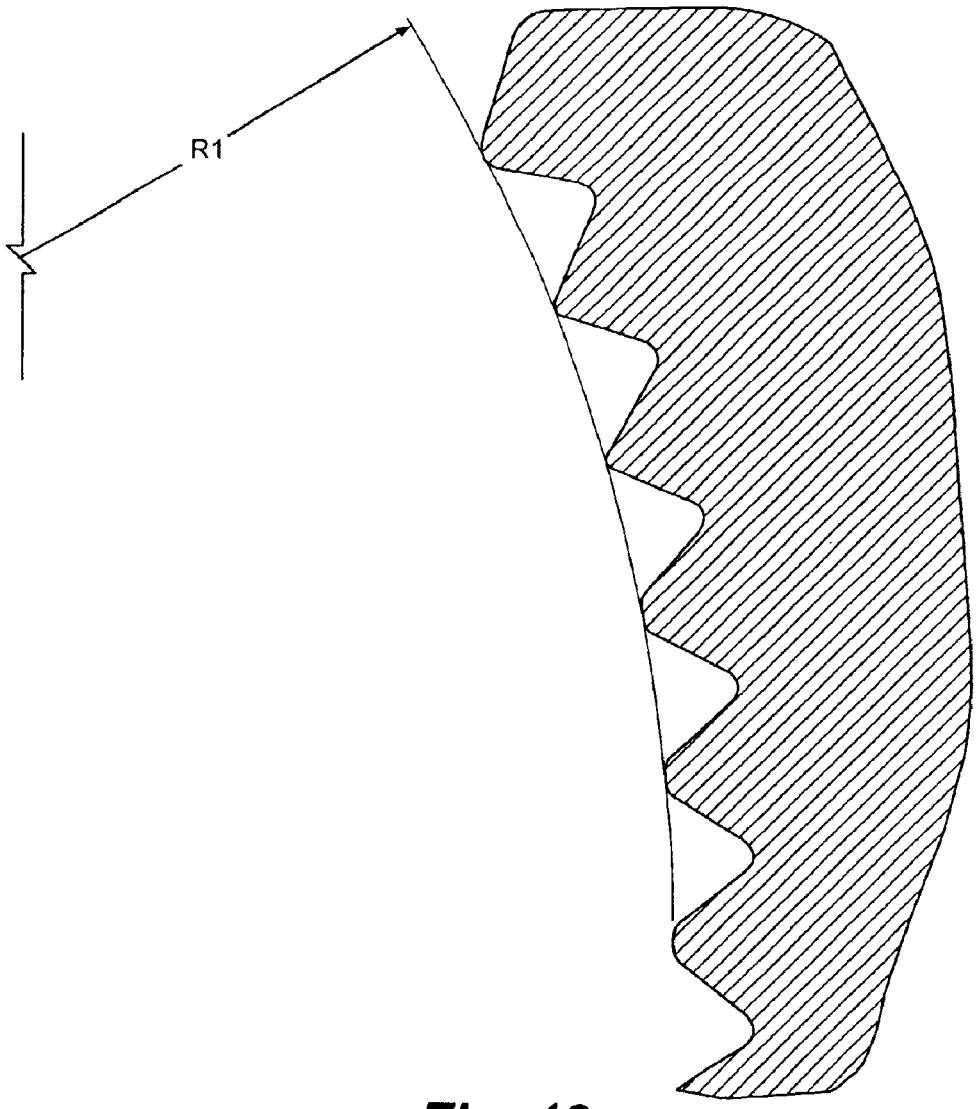
Figure 20:
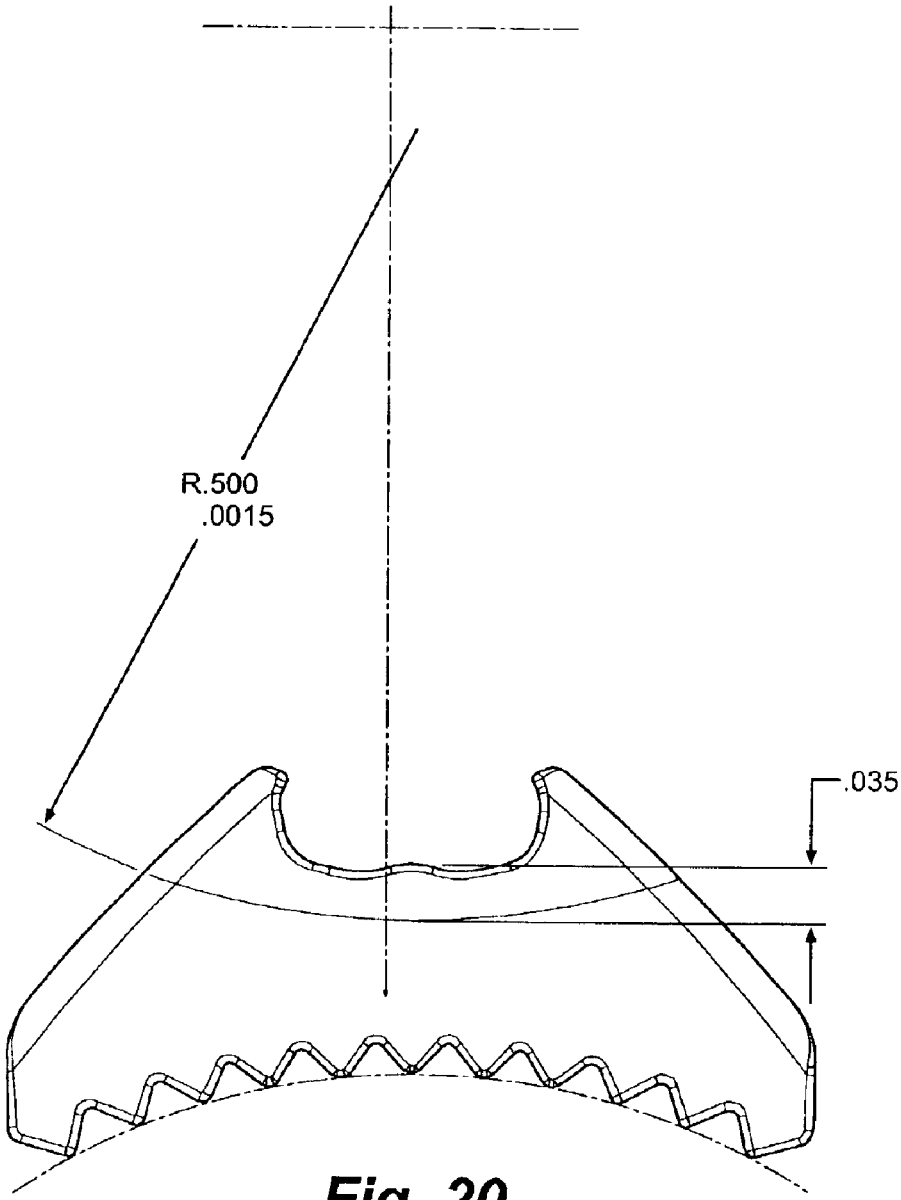
Figure 21:
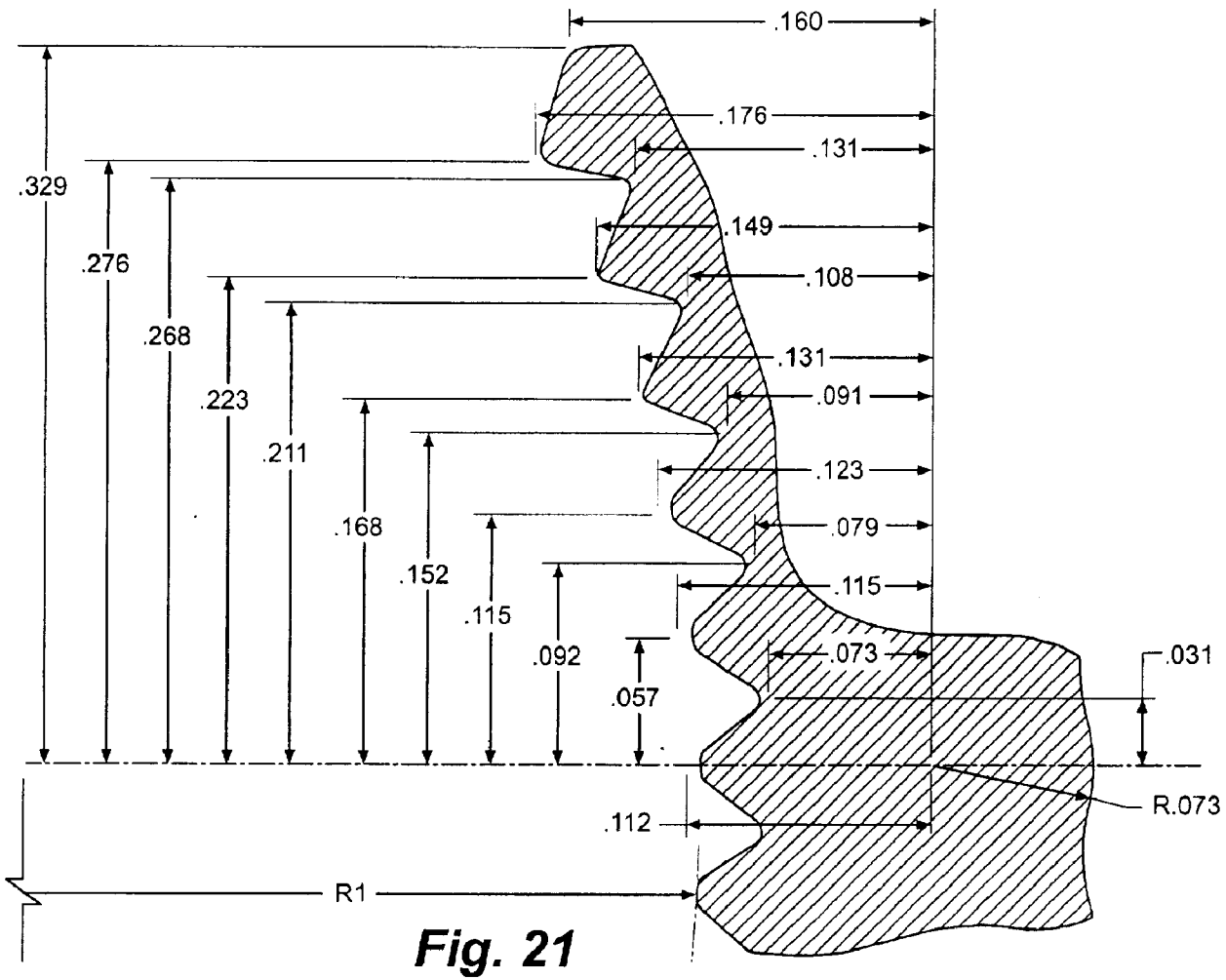
Figure 22:
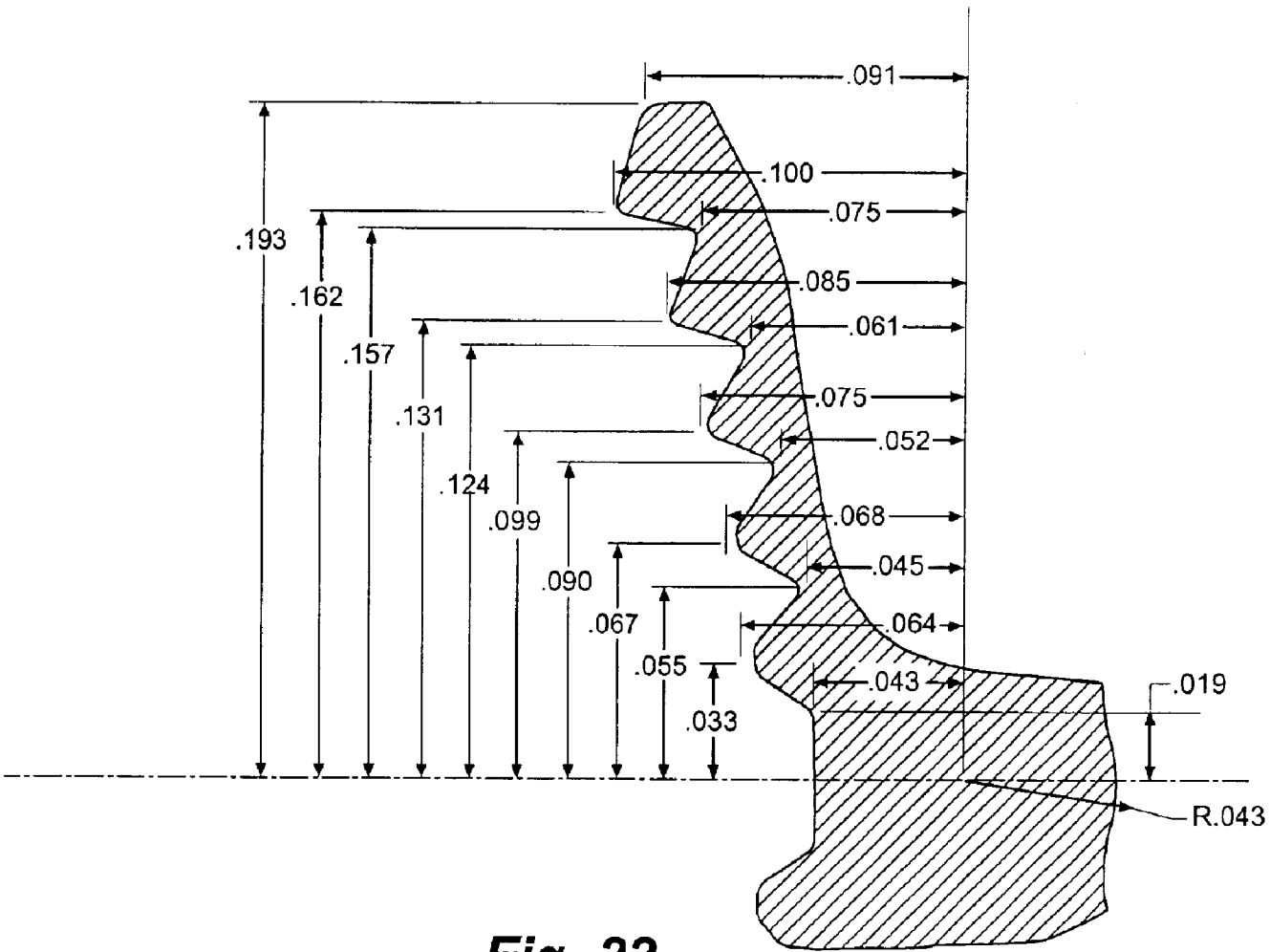
Figure 23:
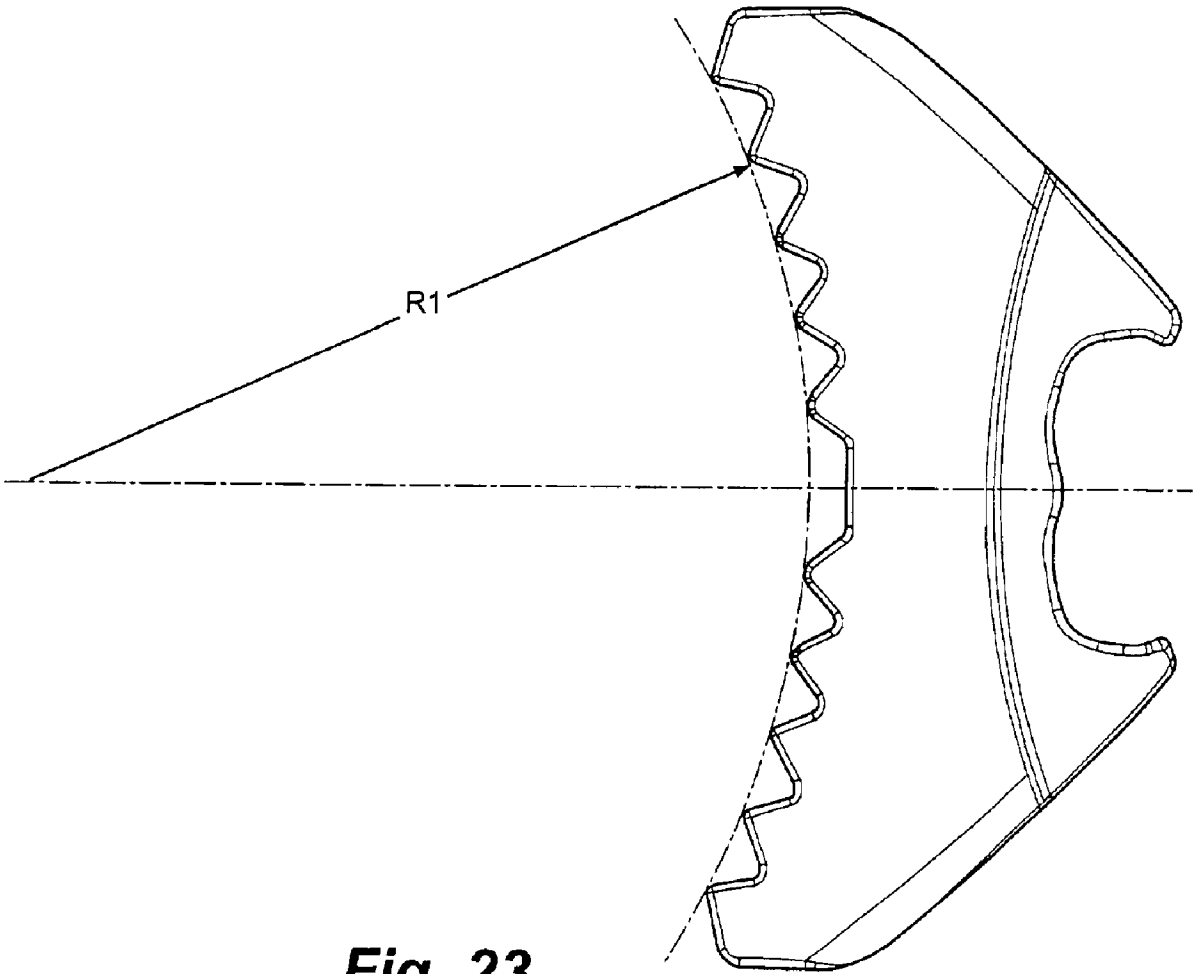
Figure 24A:
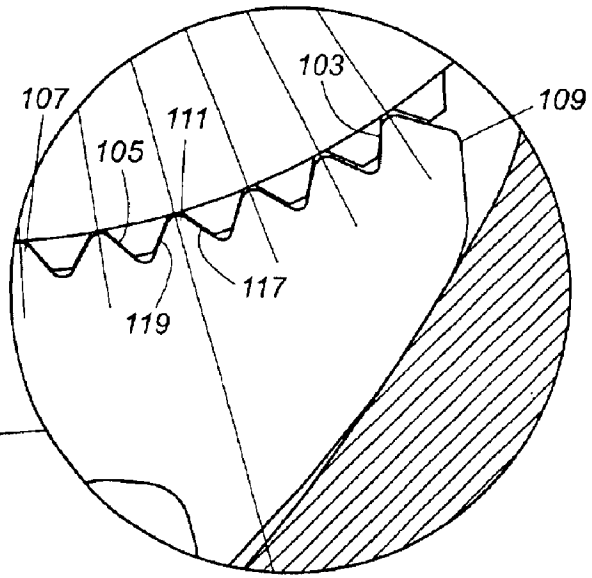
Figure 24:
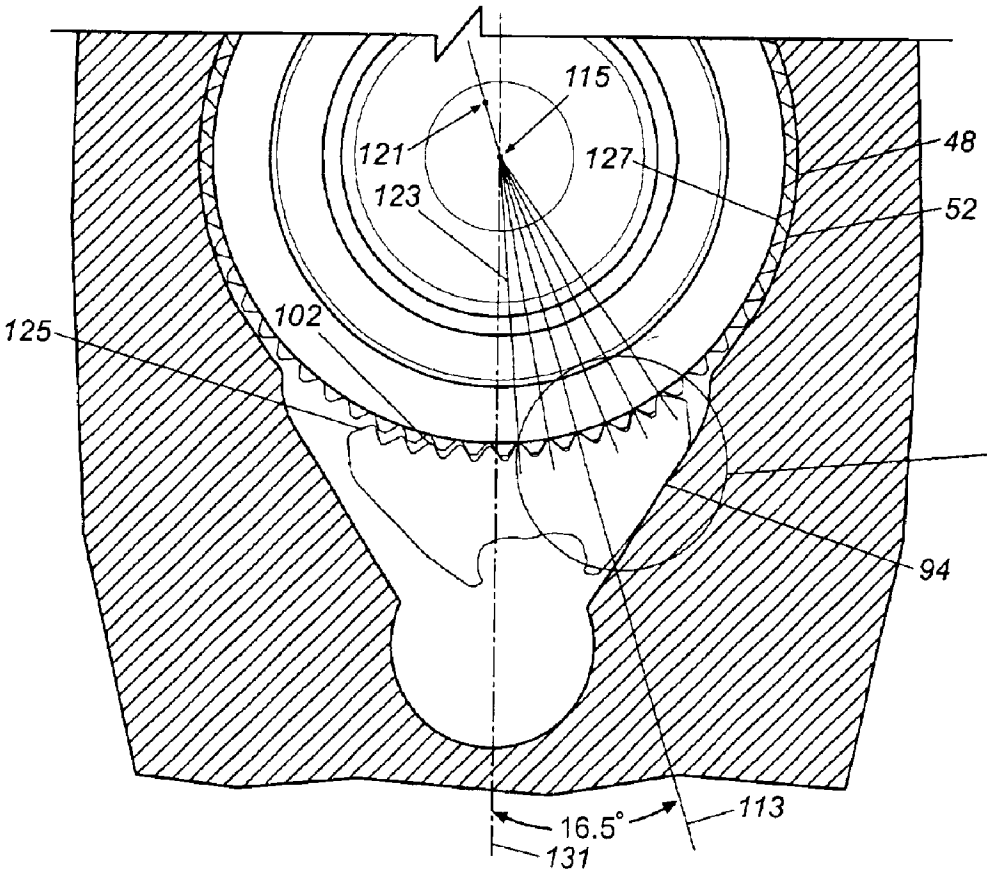

Each of FIGS. 4A, 4B, and 4C is a top view, partly in section, of the ratcheting tool as in FIG. 1;

FIG. 5A is a top view of a ratchet gear and release button of the ratcheting tool as in FIG. 1;

Each of FIGS. 5B and 5C is a side view, partly in section, of the ratchet gear and release button as in FIG. 5A;

FIG. 6 is a top view of a pawl of a ratcheting tool as in FIG. 1;

FIG. 7 is a perspective view of the pawl as in FIG. 6;

FIG. 8 is a top view of the reversing lever of the ratcheting tool shown in FIG. 1;

FIG. 8A is a partial side view, in section, of the reversing lever of FIG. 8;

FIG. 9 is a bottom view, partly in section, of the reversing lever shown in FIG. 8;

FIG. 10 is an exploded view of the reversing lever shown in FIG. 8;

FIG. 11 is a side view of a pusher as shown in FIG. 10;

FIG. 11A is a cross-sectional view of the pusher shown in FIG. 11;

FIG. 12 is a front view of the pusher shown in FIG. 11;

FIG. 13 is a perspective view of a pawl in accordance with an embodiment of the present invention;

FIG. 13A is a top view of the pawl shown in FIG. 13;

Each of FIGS. 14A, 14B, and 14C is a top view, partly in section, of a wrench in accordance with an embodiment of the present invention;

Each of FIGS. 15A, 15B, and 15C is a top view, partly in section, of a wrench in accordance with an embodiment of the present invention;

FIG. 15D is a partial cross-sectional view of the wrench shown in FIGS. 15A–15C;

FIG. 15E is a cross-sectional perspective view of a gear for use in the wrench shown in FIGS. 15A–15C;

FIG. 15F is a cross-sectional perspective view of a pawl for use in the wrench shown in FIG. 15A–15C;

FIG. 16A is a perspective view of a pawl in accordance with an embodiment of the present invention;

FIG. 16B is a back view of the pawl shown in FIG. 16A;

FIG. 16C is a bottom view of the pawl shown in FIG. 16A;

FIG. 17 is a top view of a pawl in accordance with an embodiment of the present invention;

FIG. 18 is a partial cross-sectional view of the pawl shown in FIG. 17;

FIG. 19 is a partial cross-sectional view of the pawl shown in FIG. 17;

FIG. 20 is a top view of the pawl shown in FIG. 17;

FIG. 21 is a partial cross-sectional view of a pawl in accordance with an embodiment of the present invention;

FIG. 22 is a partial cross-sectional view of a pawl in accordance with an embodiment of the present invention;

FIG. 23 is a top view of the pawl shown in FIG. 22;

FIG. 24 is a top view of components of a wrench during a design procedure in accordance with an embodiment of the present invention; and FIG. 24A is an enlarged view of a portion of the components shown in FIG. 24.

Repeat use of reference characters in the present specification and drawings is intended to represent same or analogous features or elements of the invention.

DETAILED DESCRIPTION OF PREFERRED EMBODIMENTS

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope and spirit thereof. For instance, features illustrated or described as part of one embodiment may be used on another embodiment to yield a still further embodiment. Thus, it is intended that the present invention covers such modifications and variations as come within the scope of the appended claims and their equivalents.

Referring to FIG. 1, a ratcheting tool 10 includes an elongated arm, which may be formed as a handle 12 from stainless steel, metal alloys or other suitable materials. The length of handle 12 may vary depending on the application of ratcheting tool 10. A head 14 extends from the handle 12, and the head and handle may be integrally formed from the same material.

Figure 2:
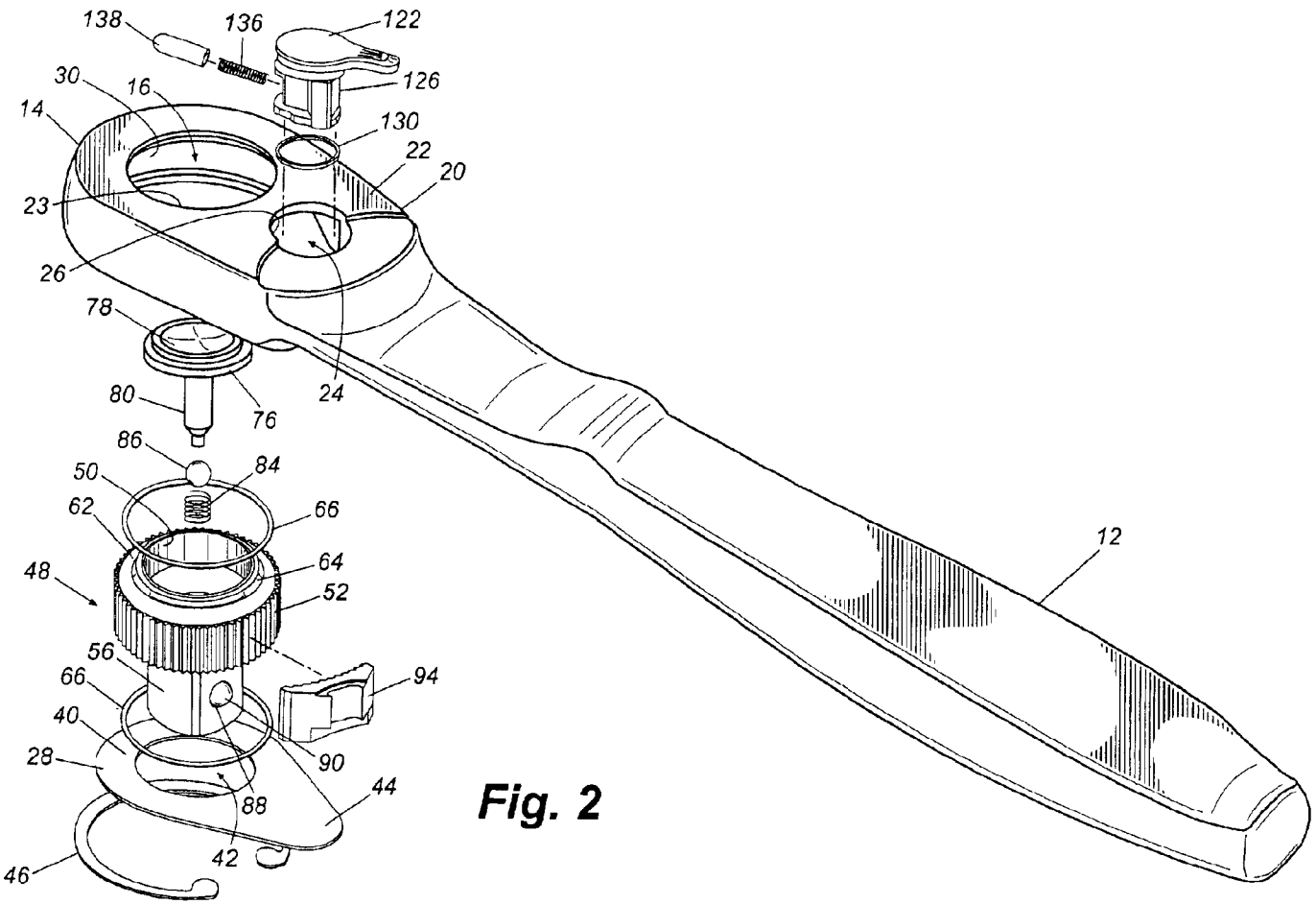
FIG. 2 is an exploded view of the ratcheting tool as in FIG. 1.
Figure 3A:
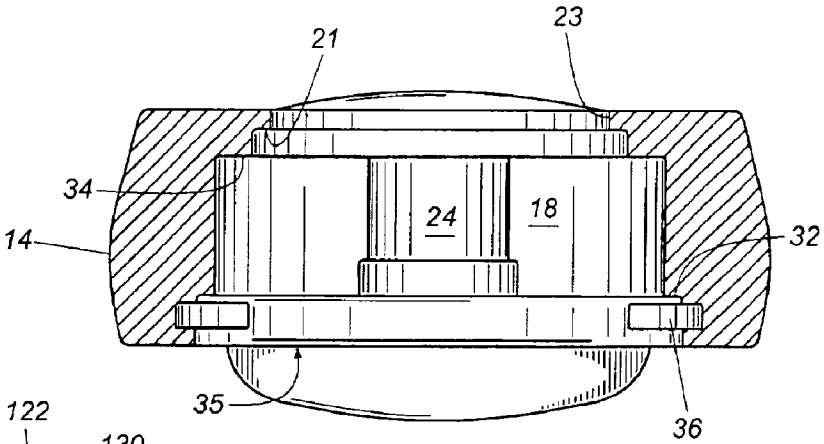
FIG. 3A is a sectional view of the body of ratcheting tool as in FIG. 1.
Figure 3B:
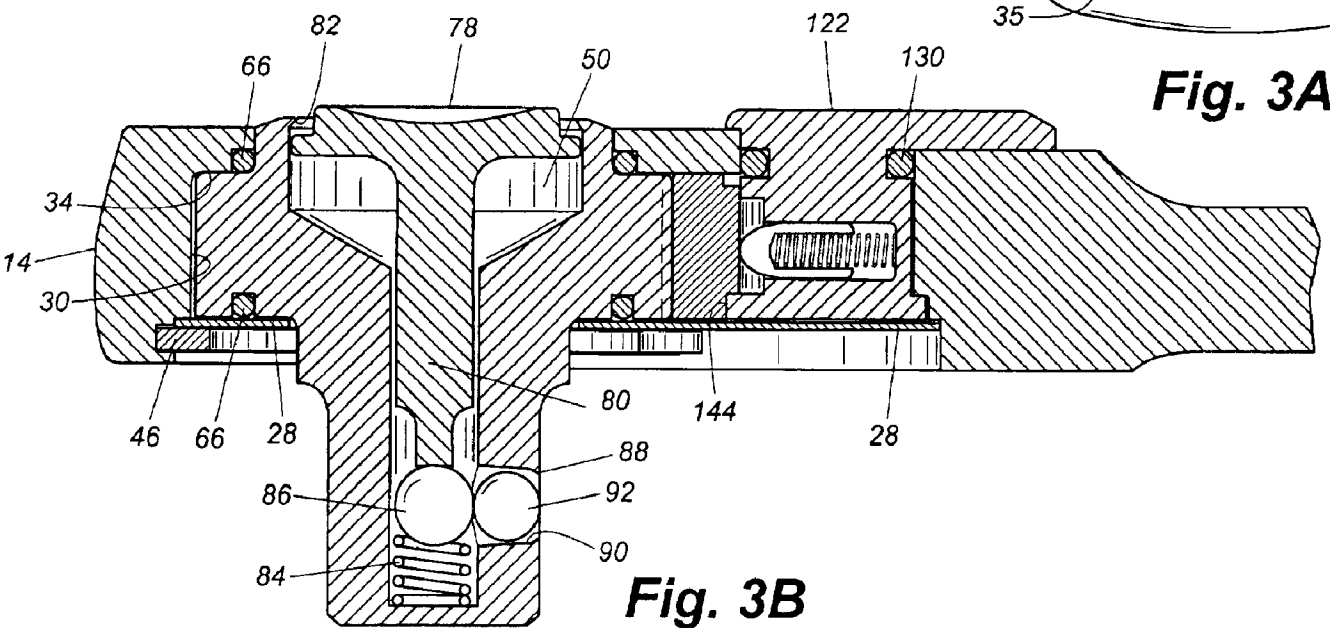
FIG. 3B is a partial sectional view of the ratcheting tool as in FIG. 1.

Referring to FIGS. 2, 3A, and 3B, head 14 defines a relatively large and generally cylindrical through-hole compartment 16. A web portion 20 is intermediate to head 14 and handle 12 and defines a smaller, wedge-shaped compartment 18 (see also FIGS. 4A–4C). A generally cylindrical compartment 24 extends through a top face 22 into web 20 at a hole 26 and overlaps compartment 18. Compartment 18 is closed above by top face 22 and opens into both compartments 16 and 24. The underside of head 14 is open and receives a cover 28 that secures certain components of ratcheting tool 10 within compartments 16, 18, and 24, as described in greater detail below.

A wall 30 defines compartment 16 between a radially outward extending ledge 32 at one end and a radially inward extending ledge 34 at its other end. An annular groove 36 is defined in a vertical wall extending down from ledge 32 and surrounding most of compartment 16.

Cover 28 has an annular portion 40 defining a hole 42 and a tab portion 44 extending from annular portion 40. An opening 35 in the bottom of head 14 and web 20 receives cover 28 so that annular portion 40 sits on ledge 32. Annular groove 36 receives a C-clip 46 to secure cover 28 between the C-clip and ledge 32 so that cover 28 is held in position over compartments 16, 18, and 24.

Compartment 16 receives an annular gear ring 48 having an inner surface 50 that is concentric with wall 30 of head 14. As shown also in FIGS. 5A to 5C, the outer circumference of gear ring 48 defines a series of vertically-aligned teeth 52. The gear ring's bottom side defines an extension portion 56 surrounded by a flat annular shoulder 58 that defines an annular groove 60. On the top side, a top ledge 62 surrounds an upwardly extending wall 64. Gear ring 48 fits into compartment 16 so that wall 64 extends through a hole 23 in top face 22 and so that ledge 62 abuts ledge 34. When cover 28 is secured to head 14, extension portion 56 extends through hole 42. Circular portion 40 abuts-shoulder 58, thereby retaining gear ring 48 in compartment 16.

Extension portion 56 and wall 64 fit through hole 42 and hole 23, respectively, with sufficient clearance so that the gear ring is secured in the radial direction yet is permitted to rotate with respect to head 14. A lower O-Ring 66 is received in annular groove 60 and abuts cover 28, while an upper O-ring extends around wall 64 between ledges 21 and 62. The O-rings aid in smooth rotation of gear ring 48 and minimize the amount of dirt and debris that can enter compartment 16. O-Rings 66 may be formed from pliable rubbers, silicones, metals, or other suitable material.

Extension portion 56 is square shaped in cross-section and is adapted to receive a standard three-eighths (⅜) inch drive socket, which should be well understood in the art. Extension 56 may also be sized to fit one-quarter (¼) inch drive, one-half (½) inch drive, or other drive size sockets as desired.

Inner surface 50 of gear ring 48 surrounds a blind bore 68 centered around the axis of gear ring 48. Bore 68 receives a push button 76 having an annular top 78 and a cylindrical shaft 80. The top end of bore 68 defines a shoulder 82 that is peened inward to retain button 76 in the bore. A spring 84 and ball 86 in the bottom of bore 68 bias button 76 upward against shoulder 82. A cylindrical bore 90 intersects bore 68 at a right angle and receives a ball 92. An edge 88 is peened inward to retain the ball in the bore.

Ball 86 controls the position of ball 92 within bore 90. Normally, when spring 84 and ball 86 push the top of button 76 up against shoulder 82, ball 86 is aligned with ball 92, thereby pushing ball 92 out against edge 88 of bore 90. In this position, a portion of ball 92 extends out of bore 90 to retain a socket on extension 56. To remove the socket, the operator pushes push button 76 down against spring 84. This moves ball 86 below bore 90 and aligns a narrowed end of shaft 80 with ball 92, thereby allowing ball 92 to move back into bore 90 and releasing the socket.

Referring to FIGS. 4A–4C, compartment 18 receives a generally wedge-shaped pawl 94 between side walls 98 and 100. Cover 28 and top face 22 (FIG. 2) of web 20 retain pawl 94 from below and above. Walls 98 and 100 are formed so that vertical planes (i.e. planes perpendicular to the page) defined by the walls intersect a vertical plane 99 that passes through the center of compartments 16 and 24 (see FIGS. 2 and 3A) at an angle such that compartment 18 optimizes the load-bearing and ratcheting capabilities of ratcheting tool 10. The size of the angle may vary depending on the tool's intended use. A larger angle, for example, allows for greater load-carrying characteristics between gear ring 48 and pawl 94, while a smaller angle provides for better ratcheting and reversing. Thus, the angle chosen in a given instance preferably provides the best combination of gear/pawl tooth loading and clearance for the pawl during ratcheting and reversing. In a preferred embodiment, the angle between plane 99 and each of side walls 98 and 100 is 31 degrees and is preferably within a range of 27 degrees to 35 degrees.

As shown in FIGS. 6 and 7, pawl 94 defines a plurality of vertically-aligned teeth 102 across the pawl's front face in an arc having a radius R1. In the illustrated embodiment, the tips of the teeth are rounded slightly, and R1 is measured to the rounded tips of the teeth. The radius R1 is different than a radius R2 (FIG. 5A) between the center 68 of gear ring 48 and the troughs of its teeth 52. Because of manufacturing tolerances, the tips of the pawl teeth and the troughs of the gear teeth vary slightly in the radial direction, as should be understood in this art. Thus, radii R1 and R2 should be understood to lie within the pawl and gear tolerance ranges and are assumed to extend to the mid-points of the respective tolerance range for purposes of this discussion. Furthermore, it should be understood that radii R1 and R2 may be taken at other locations on the gear and the pawl, for example at the tips of the gear teeth and the troughs of the pawl teeth.

The back face of pawl 94 defines a pocket 104 having two curved portions 108 and 110 separated by a bridge 112 and having symmetric rearwardly-extending sides 114 and 116. A notch 118 extends into the back end of pawl 94 from a bottom surface 120.

Referring to FIGS. 8, 8A, 9, and 10, a reversing lever 122 includes a handle portion 124 and a bottom portion 126. The outer surface of bottom 126 defines an annular groove 128 that receives an O-ring 130, which extends slightly outward of groove 128. Groove 128 is located proximate handle portion 124 such that an annular shelf 132 extends between groove 128 and the front of handle 124. Bottom 126 defines a blind bore 134 that receives a spring 136 and pusher 138. Referring to FIGS. 11, 11A, and 12, pusher 138 is cylindrical in shape and defines a blind bore 140 in its rear end and a rounded front end 142. Bore 140 is adapted to receive spring 136 so that the spring biases pusher 138 radially outward from bore 134.

Referring to FIGS. 2, 3B, 8A, and 10, hole 26 in web 20 receives the lever's bottom portion 126. The diameter of bottom portion 126 is approximately equal to the diameter of hole 26, although sufficient clearance is provided so that the reversing lever rotates easily in the hole. Upon insertion of bottom portion 126 into hole 26, the hole's side pushes O-ring 130 radially inward into groove 128 so that the O-ring thereafter inhibits the entrance of dirt into the compartment. Referring also to FIG. 6, pusher 138 extends into pocket 104 and engages curved portions 108 and 110 and sides 114 and 116, depending on the position of the pawl and lever. A radially outward extending lip 144 at the bottom of the lever fits into notch 118 in the pawl, and a lip 145 extends into a groove at the bottom of compartment 24, thereby axially retaining lever 122 its compartment.

In operation, as shown in FIGS. 4A to 4C, pawl 94 may slide to either side of compartment 18 laterally with respect to the gear between two positions in which the pawl is wedged between the body and the gear. In FIG. 4C, lever 122 is rotated to its most clockwise position, and pawl 94 is wedged between gear ring 48 and top side 98 of compartment 18. Spring 136 pushes the pusher forward so that the pusher's front end 142 engages pocket side 114 and thereby biases the pawl to the wedged position. If torque is applied to handle 12 (FIG. 2) in the clockwise direction when a socket on the gear extension engages a work piece, the top side of compartment 18 pushes pawl teeth 102 on the top portion (from the perspective of FIG. 4C) of the pawl against opposing gear teeth 52. That is, the pawl remains wedged between the gear ring and the compartment's top edge, and the force applied from the operator's hand to the pawl through top side 98 is therefore applied in the clockwise direction to the work piece through gear ring 48.

If an operator applies torque to the handle in the counterclockwise direction, gear teeth 52 apply a counterclockwise reaction force to pawl 94. If gear ring 48 remains rotationally fixed to a work piece through a socket, teeth 52 hold the pawl so that the pawl pivots slightly about the third tooth in from the top end of the pawl (as viewed in FIG. 4C) and moves back and down into compartment 18. This causes pawl pocket side 114 to push back against pusher tip 142 and the force of spring 136 until pawl teeth 102 ride over the gear teeth. Spring 136 then moves the pusher forward against side 114, forcing pawl 94 back up toward the top face of compartment 18 and into the next set of gear ring teeth. This ratcheting process repeats as the operator continues to rotate handle 12 counterclockwise.

To change the operative direction of ratcheting tool 10, the operator rotates switch 122 in the counterclockwise direction (as viewed in FIG. 4B). Lever bottom portion 126 (FIG. 2) rotates in hole 26, and the pusher moves counterclockwise in the pawl pocket through curved portion 108 toward bridge 112 (FIG. 6). Initially, the pawl pivots slightly, and the load-bearing pawl teeth move away from the gear teeth. As the pusher moves toward the bridge, the pawl begins to shift down and back in compartment 18. Further rotation brings the pusher into contact with the bridge, causing the pawl teeth to ride down and back into compartment 18 over the gear teeth. Gear ring 48 may also rotate slightly. In this position, pawl 94 moves the pusher back against the force of spring 136. As the operator continues to rotate switch 122, the pusher moves into curved portion 110 and pushes forward against wall 116. This applies a counterclockwise force to the pawl so that the pawl moves downward in compartment 18 and wedges between the gear ring and the compartment's bottom edge 100. When the pawl has moved over to this wedged position, the configuration and operation of the gear, the pawl, and the lever mirror the pawl's operation described above with respect to FIG. 4C. That is, the tool ratchets and applies torque to a work piece in the same manner but in the opposite direction.

FIGS. 17 to 20 provide dimension details for a pawl 94 sized for a three-eighths (3/8) inch drive ratchet. As should be understood in this art, the ratchet's "size" refers to the size of internal squares of sockets it accepts. Generally, the actual size of the ratchet tool, including its gear and pawl, varies with the tool's rated size. The dimension examples below are provided solely to illustrate one exemplary variation among such tool sizes but are not intended to limit the present invention to those dimensions. Moreover, a description is provided below of a method according to an embodiment of the present invention by which certain dimensions of the pawl may be determined for a tool and gear of a given variable size. Thus, it should be understood that various arrangements of the present invention may be suitable in various circumstances.

It should also be understood, for example that the construction of other components may vary. For example, the reversing lever may be formed as a ring concentric with the gear and having an extension that fits into the pawl so that rotation of the ring moves the pawl laterally across the compartment.

As indicated previously, the radius R1 of a curve defined by the tips of the pawl teeth is larger than the radius R2 (FIG. 5A) of a curve defined by the troughs of the gear teeth. The ratio of R1 to R2 is preferably within a range of 1:1.08 to 1:1.3. In the example shown in FIGS. 18–21, the ratio is 1.0 to 1.12, where radius R1 equals 0.458 inches. The depth of the gear teeth and the pawl teeth is approximately 0.020 inches.

Preferably, the gear teeth are formed uniformly about the gear's circumference. The depth of each tooth, which may be defined as the distance along a radius of the gear extending between the tooth's tip and an arc connecting the troughs beside the teeth, is the same. The internal angle between the sides of a tooth (the "included" angle) is the same for each tooth, and the angle between sides of adjacent teeth (the "adjacent" angle) is the same for each pair of adjacent teeth.

The dimensions of the pawl teeth, and the ratio between gear radius R2 (FIG. 5) and pawl radius R1 (FIG. 18), may be determined by modifying an initial assumption that the pawl teeth will exactly fit the gear teeth. That is, the depths, included angles and adjacent angles of the pawl teeth initially match the corresponding dimensions of the gear teeth. Both sides of each pawl tooth are then pivoted (for example, using a computer-aided design ("CAD") system) toward each other by 1.5 degrees about the tooth's theoretical tip, thereby reducing the tooth's included angle by approximately 3 degrees. The non-loaded side 105 of each of the three outermost teeth on each side of the pawl is then shaved by 0.003–0.005 inches, and the tips of the teeth are rounded. The degree of rounding increases from the outermost teeth to the pawl center so that the rounded tips define a common radius (within manufacturing tolerances). As will be appreciated, this procedure results in a slightly non-flush engagement between the load-bearing sides 103 of the pawl teeth and the opposing gear tooth sides.

Because the pawl radius R1 (FIG. 18) is larger than the gear radius R2 (FIG. 5A), the included angles $\alpha$ and adjacent angles Φ of the pawl teeth are not uniform, as can be seen in FIG. 18. The variation results from pivoting the pawl teeth's non-load-bearing sides 105 so that the included angle α of each tooth is reduced by a desired amount (preferably one to two degrees) less than the included angle of the gear teeth. This adjustment results in a slight gap between the non-load-bearing gear teeth sides and the non-load-bearing pawl teeth sides 105. The gap reduces or eliminates fluid adhesion (caused by grease or oil in the mechanism) and taper fit between the gear and pawl teeth, thereby facilitating smooth removal of the pawl teeth from the gear teeth during ratcheting and pawl reversal.

FIG. 18 illustrates the dimensions of pawl teeth to one side of a center tooth 107. The dimensions and positions of the teeth on the opposite side of tooth 107 are a mirror image of the illustrated side and are therefore not shown. Similarly, FIG. 19 provides rounding radii for the tips and troughs of the teeth of same pawl side. These configurations are also mirrored on the other side of the pawl.

FIG. 21 illustrates a pawl used in a ratchet sized for one-half (½) inch drive sockets. The pawl radius R1 (FIG. 17) is scaled by the ratio of the gear diameter for the one-half inch ratchet (e.g. 1.155 inches) to the gear diameter for the three-eighths inch ratchet (e.g. 0.866 inches), to obtain a pawl radius R1 (FIG. 21) of 0.611 inches. The ratio of the pawl radius to the gear radius is again 1:1.12, and the depth of the gear and pawl teeth is approximately 0.028 inches.

It should be understood that the ratio of the gear diameters is used to scale the dimensions of the pawl, reversing lever, ratchet head, and other ratchet components. The gear diameter for determining the ratio is measured between the tips of the gear teeth. When determining the ratio of the pawl radius to the gear radius, R1 is measured to the tips of the pawl teeth (FIG. 17), and R2 is measured to the troughs of the gear teeth (FIG. 5A).

FIGS. 22 and 23 illustrate a pawl used in a ratchet sized for one-quarter (¼) inch drive sockets. The depth of the gear and ratchet teeth is approximately 0.015 inches. As with the one-half inch size, it is possible to define the pawl radius for the quarter-inch ratchet by scaling the three-eighths inch pawl radius by the ratio of the gear sizes. Where, however, such direct reduction in scale brings the gear teeth and pawl teeth to dimensions at which manufacturing tolerances could lead to interference between the engaged teeth, the pawl design steps are preferably re-executed. Thus, the pawl dimensions may be determined through the same steps as described above for the three-eighths inch design, except that (1) the non-loaded sides of all pawl teeth are shaved, (2) the non-loaded sides are shaved by approximately 0.001–0.002 inches, and (3) the two center pawl teeth are removed. The resulting pawl radius R1 in FIG. 23 is 0.347 inches—slightly smaller than what it would be if the radius were directly scaled from the three-eighths inch ratchet according to the ratio of the gears (e.g. 0.773). Similarly, the ratio of the pawl radius to the gear radius is 1:1.09—again, slightly different from the three-eighths and one-half inch ratchets.

FIGS. 17–23 illustrate that the gear/pawl radius ratio may vary among tools of different sizes, but the ratio may also vary among tools of the same size. That is, the particular ratio for a given tool may be selected independently of other tool designs, preferably within a range of 1:1.08 to 1:1.3. A ratio for a particular tool design may be determined by trial and error, but it is believed that the two primary factors determining an appropriate range for the radius ratio are (1) the gear radius and (2) the depth of the teeth on the gear and the pawl. Once these parameters are chosen, a radius ratio may be selected on a CAD system or other graphic means through an alternate method described with respect to FIG. 24.

FIG. 24 represents a CAD depiction of a gear 48 and a pawl 94. The operation of CAD systems should be well understood in this art and is therefore not discussed herein. Initially, the pawl and gear are disposed so that they face one another. The body of the ratchet wrench head is illustrated for purposes of context but is preferably omitted from the CAD drawing. The theoretical (i.e. non-rounded) tip of each pawl tooth lies on a respective line 123 that passes through the center 115 of gear 48 and the trough between the opposing gear teeth on the loaded side of the pawl. The included angles a (FIG. 18) are consistent across all pawl teeth and are the same as the gear teeth adjacent angles. The depth of the pawl teeth is the same as the depth of the gear teeth, and all teeth are as yet not rounded. An initial gear/pawl radius ratio is selected arbitrarily. The adjacent angle Φ (FIG. 18) depends on the selected initial radius ratio but is the same for all pawl teeth. If a 1:1 ratio is selected, the pawl's adjacent tooth angle Φ is the same as the adjacent angle between the gear teeth.

Next, a pivot tooth is selected on one side of the pawl's center tooth. Preferably, the pivot tooth is the principal load-bearing tooth. The particular number of load-bearing teeth on either pawl side depends on the density of teeth on the pawl, the design of the back of the pawl and the design of the compartment wall against which the pawl sits. Given a design where these factors are known, the load-bearing teeth may be identified by applying very high loads to a ratchet and observing which teeth are first to shear or by simply assessing the design from experience with prior designs. In the embodiment shown in FIG. 24, the load-bearing teeth are the four outermost teeth inward of pawl end 109, and the pivot tooth is preferably tooth 111—the closest one of these teeth to center tooth 107 (FIG. 18).

After selecting the pivot tooth, the pawl is moved so that pivot tooth 111 is received in exact alignment with the gap between adjacent teeth 117 and 119 on the gear. That is, tooth 111 is fully received in the gap between teeth 117 and 119, and its sides 103 and 105 are flush against the opposing sides of teeth 117 and 119, respectively. If the initial radius ratio is not 1:1, the pivot tooth is the only tooth that fits exactly between its opposing gear teeth. The teeth on either side of the pivot tooth are increasingly misaligned with the gaps between their opposing gear teeth.

The final pawl radius is defined along a radius line 113 that includes center 115 of gear 48 and the non-rounded tip of the pivot tooth. A point 121 on line 113 is initially defined as the center of curvature of the non-rounded tips of the pawl teeth as originally drawn on the CAD system. That is, point 121 is the origin of the pawl radius, and the pivot tooth defines the point at which an arc defined by the gear radius is tangent to an arc defined by the pawl radius. To determine the final pawl radius(in this instance, the radius to the theoretical tips of the pawl teeth), point 121 is moved along line 113 behind point 115. The adjacent angles Φ between the pawl teeth change in accordance with the changing pawl radius. The pawl teeth depth and included angles, as well as the alignment of the pivot tooth in the gap between its opposing gear teeth, remain fixed. As point 121 moves closer to gear center point 115 along line 113, the pawl radius decreases, and the pawl teeth on either side of the pivot tooth move closer into the gaps between the opposing gear teeth. Conversely, the pawl radius increases as point 121 moves away from center point 115, and the pawl teeth on either side of the pivot tooth move away from the gear teeth. Preferably, point 121 is selected so that the non-rounded tip of the outermost tooth 125 on the opposite side of center tooth 107 from the pivot tooth is within one-half to fully out of the gap between its opposing gear teeth. That is, assume that an arc defined by troughs 127 between the gear teeth is assigned a value of zero and that an arc defined by the gear tooth tips is assigned a value of 1. The tip of pawl tooth 125 preferably is disposed within a range including and between two intermediate arcs located at 0.50 and 1.0.

In an alternate embodiment, the pivot tooth is determined through selection of radius line 113, rather than the other way around. Once the pawl has been located by the CAD system at one of the two wedged positions in engagement with the gear, line 113 is drawn at 25 degrees with respect to center line 131 so that line 113 passes through the loaded side of the pawl. The tooth through which the line passes is chosen as the pivot tooth, and line 113 is rotated about point 115 so that it passes through the tip of the selected tooth. If line 113 passes exactly between two pawl teeth, either tooth may be selected, but the outer tooth is preferred. Following selection of the pivot tooth and adjustment of line 113, the pawl radius is determined in the same manner as discussed above.

Once the pawl radius, and therefore the gear/pawl radius ratio, have been determined, the pawl teeth are modified to their operative dimensions. The pawl remains located by the CAD system in the wedged position against the gear as shown in FIG. 24, and the pivot tooth remains in exact alignment with its opposing gear teeth. The non-loaded side 105 of each tooth, including the pivot tooth, is pivoted about the tip of the tooth so that the tooth's included angle is preferably one to two degrees less than the adjacent angle of the gear teeth. The side of the center tooth facing the loaded pawl teeth is adjusted in this step as a non-loaded side. The load-bearing sides 103 are not adjusted. Thus, except for the pivot tooth, the load-bearing sides of the pawl teeth are slightly out of flush with their opposing gear tooth sides.

This defines the dimensions of the gear teeth on one side of the pawl. The teeth on the other pawl side are then adjusted to be the mirror image (across the pawl's center line) of the first side. The pawl (and gear) teeth are rounded as desired. As indicated in FIG. 19, the rounded tips preferably remain on a common arc.

At this point, the pawl tooth design is complete, and a pawl with the selected dimensions may be operated in a tool as shown in FIGS. 4A–4C. In particular, the selection of the pawl radius so that the tip of the outermost non-loaded tooth is one-half to fully out of the gear teeth generally assures that when one side of the pawl or the other is wedged in the pawl compartment in engagement with the gear, only the teeth on that side are loaded against the gear teeth. The teeth on the trailing side remain unloaded.

Although the discussion above describes a gear/pawl arrangement in a ratchet, it should be understood that the present invention may encompass other ratcheting tools, for example a ratcheting GEAR WRENCH as shown in FIGS. 15A to 15F. Generally, ratcheting GEAR WRENCH 310 operates under the same principles as ratcheting tool 10 (FIG. 1). GEAR WRENCH 310 includes a handle 312 and a head 314 extending from the handle, which may be formed from a suitable material such as stainless steel or a metal alloy. Handle 312 may be a solid piece and has a generally rectangular transverse cross-section, although the length and cross-sectional shape of handle 312 may vary as desired.

Head 314 includes a wall 328 that defines a generally cylindrical through-hole compartment 316. A smaller, semi-circular compartment 318 is defined in a web portion 320 intermediate head 314 and handle 312. A generally cylindrical compartment 324 extends through face 322 into web 320 and overlaps compartment 318. Compartment 318 is closed above and below by top and bottom surfaces of web 320, and compartment 318 opens into both compartments 316 and 324. A groove 330 about compartment 316 extends into head 314 from wall 328 proximate the top edge of the wall for receipt of a C-clip as discussed below. An annular ledge 334 extends radially inward into compartment 316 from wall 328 proximate the wall's bottom edge.

Compartment 318 differs from the pawl compartment described above in ratcheting tool 10 (FIG. 2) in that both the top and bottom faces of head 14 are closed over the compartment. Compartment 318 may be formed by a keyway cutter or a computer numeric controlled (CNC) milling machine that cuts compartment 318 with a cutting tool inserted into compartment 316. The cutting tool has a shaft with a disk-shaped cutter at the end of the shaft, and cutting edges are formed about the disk's circumference. The disk's radius is greater than the depth of compartment 318 between compartments 316 and 324, and the disk's height is less than the thickness of web 20. The tool is initially inserted into compartment 316 so that the tool's axis passing through the center of the disk and the shaft is parallel to the axis of cylindrical compartment 316. That is, the cutting disk is generally coplanar with the compartment.

Compartment 316 receives a gear ring 336. The gear ring has an inner surface 338 that is concentric with wall 328 and that defines a plurality of aligned flats 350 spaced equiangularly about inner surface 338 to engage the sides of a bolt, nut or other work piece. The outer circumference of gear ring 336 defines a series of vertically-aligned teeth 340. A bottom side of gear ring 336 defines an extension portion 342 surrounded by a flat annular shoulder 344. Extension portion 342 fits through ledge 334 so that shoulder 344 sits on the ledge and retains gear ring 336 in the lower axial direction. Extension portion 342 fits through ledge 334 with sufficient clearance so that the ledge secures the gear ring in the radial direction yet permits the gear ring to rotate with respect to head 314.

Gear ring 336 defines an annular groove 346 about its outer surface proximate its upper end. A C-ring 348 extending from groove 346 is compressed inward into the groove as the gear ring is inserted into the head. When grooves 300 and 346 align, the C-ring snaps into groove 330, thereby securing gear ring 336 in the upper axial direction.

A Pawl 394 is received in compartment 318 so that the top and bottom surfaces of compartment 318 retain the pawl from above and below. A reversing lever 372 includes a handle portion 374 and a bottom portion 376 extending below the handle portion. Bottom 376 defines a blind bore 391 that receives a spring 386 and a generally cylindrical pusher. The pusher defines a blind bore 390 in its rear end and a rounded tip at its front end. Bore 390 receives spring 386, and the spring biases pusher 388 radially outward from bore 391.

Hole 326 in web 320 receives lever bottom portion 376. The outer diameter of bottom portion 376 is approximately equal to the inner diameter of hole 326, although sufficient clearance is provided so that the reversing lever rotates easily in the hole. The pusher extends into the pocket in the back of the pawl, and rotation of the lever moves the pawl across compartment 318 between its two wedged positions in the same manner as discussed above with respect to the ratchet.

Similarly to the ratchet, the wrench illustrated in FIGS. 15A–15F may be manufactured to different sizes. The size is denoted by the size of the work piece received within the gear so that flats 350 engage and apply torque to the work piece. That is, for example, a ¼ inch wrench can turn a ¼ inch hex fastener.

As with the ratchet, the sizes of the gear and the pawl in the wrench vary with the size of the overall tool. In one preferred embodiment, the tooth depth on both the gear and the pawl is approximately 0.012 inches. As with the ratchet, the tips of the pawl teeth define a curve having a radius that is larger than a radius of a curve defined by the troughs of the gear teeth. The ratio of the gear radius to the pawl radius for a given wrench may be determined in the same manner as described above and is preferably within range of 1:1.08 to 1:1.3. In one preferred embodiment of a one-quarter inch drive ratchet wrench, the gear/pawl radius ratio is 1:1.09. In exemplary five-sixteenth, one-half, five-eighths, and three-quarter inch wrenches, the ratio in each wrench is within the range of 1:1.08 to 1:1.30.

As is apparent by a comparison of FIGS. 3A–4C to FIGS. 15A–15F, the socket ratchet and the drive ratchet wrench differ in the shape of their pawl compartments and in that the pawl compartment of the socket ratchet is enclosed by a separate cover plate, whereas the pawl compartment of the drive ratchet wrench is enclosed on top and bottom by the web. There is also a difference in the shape of the pawl compartments and, as described in more detail below, in the gear and pawl profiles. It should be understood, however, that these embodiments are presented by way of example only. Thus, for instance, it is possible to construct a drive ratchet with an open pawl compartment and a socket ratchet with a closed pawl compartment.

Returning to FIGS. 15A–15F, the difference in the shape of compartment 318 results in a different construction of the rear portion of the pawl. For example, compartment 318 is more shallow than the compartment shown in the tool of FIGS. 4A–4C, and the pawl is therefore more narrow from front to back. In addition, the curved walls of compartments 318 at areas 352 and 354, at which pawl surfaces 356 and 358 engage the compartment when the pawl is wedged between the compartment wall and the gear, define a different curve. In an alternate embodiment, however, the cutting tool flattens wall areas 352 and 354 after the initial key-way cut so that a plane defined by each surface (i.e. a plane perpendicular to the page) defines a desired angle Θ with respect to the tool's center line 319, as indicated in FIG. 15B. In a preferred embodiment, this angle is preferably within a range of 27 degrees to 35 degrees, for example approximately 31°.

In addition, FIGS. 15A–15F illustrate that the gear and pawl teeth need not necessarily extend straight from the top to the bottom of the gear and pawl. In the socket ratchet example discussed above, the toothed portion of the gear is cylindrical in shape. That is, if the gear is positioned so that the cylinder axis is vertical, the gear teeth extend in straight vertical lines between the opposite axial ends of the gear. Correspondingly, the pawl teeth also extend in straight vertical lines between the top and the bottom of the pawl face. As should be understood in this art, however, it is also possible to form the gear so that the diameter of the outside gear surface at the center of the gear is less than the diameter at the top and bottom. That is, the gear's outer surface is concave, and the gear teeth extend vertically between the top and bottom of the gear in an inward curve. Thus, FIG. 15A, which illustrates a top view of a section of the gear taken mid-way between the gear's top and bottom ends, illustrates the gear teeth curving outward toward the gear's bottom edge. The pawl face is formed in a correspondingly convex shape so that the pawl teeth extend between the top and bottom of the pawl in an outward curve to interengage with the gear teeth. Examples of a concave gear and a convex pawl are shown in FIGS. 15E and 15F.

As discussed above, the pawl teeth are disposed on an arc that defines a radius greater than the radius of the gear teeth. In defining the radius ratio, the gear tooth radius and pawl tooth radius are preferably considered at a plane passing mid-way between the top and bottom halves of the gear and the pawl, as shown in FIGS. 15A–15C.

As also indicated in FIGS. 15A–15C, the center two pawl teeth may be eliminated to form a bridge 360. This does not affect the design of the teeth on either side of the bridge. For example, a full set of pawl teeth may be designed as discussed above, with an additional step of eliminating the center or, if the pawl's center line runs between two teeth instead of a single center tooth, the two center teeth. As should be understood in this art, the center teeth perform little or no work. It is believed that their removal may facilitate the pawl's ratcheting and transition movements.

Referring particularly to FIGS. 15E and 15F, a radius 700 of the arc extending between opposite axial edges of the gear and defined by the troughs between concave vertical gear teeth 52 may be equal to a radius 702 of the arc extending between top and bottom sides of the pawl face and defined by the edges of convex vertical pawl teeth 102. However, to allow for the effects of manufacturing tolerances in the alignment of the vertical teeth on the gear and the pawl, and of twisting deformation of the gear under high torque loads, the pawl's convex radius 702 is preferably less than the gear's concave radius 700. In an embodiment of a three-quarter inch drive ratchet wrench, for example, concave gear radius 700 is 0.236 inches, while convex pawl radius 702 is 0.156 inches. This arrangement permits effective operation of the wrench even if the gear and/or pawl teeth are as much as 0.015 inches out of vertical alignment. It should be understood that such a mismatch between the concave vertical gear radius and the convex vertical pawl radius may be practiced regardless of the relationship between the circumferential radii of the gear teeth and the pawl teeth. That is, the concave and convex radii may be different regardless whether the radius defined by an arc connecting the troughs of the gear teeth is equal to or different from the radius defined by an arc connecting the tips of the pawl teeth.

Additionally, it should be understood that the concave and convex radii of the gear and the pawl, respectively, may be defined at any suitable position on the gear and the pawl that oppose each other when the pawl teeth engage the gear teeth. Thus, for example, the concave gear radius may be defined at the edge of the gear teeth while the convex pawl radius may be defined at the troughs between the pawl teeth.

Furthermore, the construction of the ratcheting tool may affect the extent or the desirability of a mismatch between the concave and convex radii of the gear and the pawl. For example, a gear in a tool as shown in FIG. 15D, in which the gear is retained from the top by a C-clip, may be subject to greater twisting deformation than a gear retained from the top by the tool head itself, as in FIG. 3B, because the latter construction exerts greater resistance against forces in the upward direction typically applied through the gear when the tool is in use. Accordingly, while a mismatch between the profile radii of the gear and the pawl may be employed in either arrangement, it is particularly desirable in a construction in which the gear is retained from the top by a retainer other than the wrench body, such as in the embodiment shown in FIG. 15D.

As discussed above, the definition of a ratio between the gear radius and the pawl radius that is less than 1:1 (i.e., the gear radius is less than the pawl radius) facilitates the pawl's removal from the gear when the pawl transitions from one side of the pawl compartment to the other. Referring to FIGS. 13, 13A, and 14A–14C, this may also be accomplished by a pawl 400 having a shape similar to the pawl shown in FIGS. 15A–15C, primarily except that (1) the pawl teeth are disposed uniformly across the face of the pawl at a radius equal to the gear radius and (2) the pawl is formed in two halves hinged together so that the halves pivot with respect to each other. The pawl may be disposed in a compartment 410 of a wrench 412 constructed like the wrench of FIGS. 15A–15F. While the construction of the wrench is, therefore, not discussed in further detail, it should be understood that the pawl may be employed in a variety of wrench and ratchet designs and may be used in other types of ratcheting tools. Thus, it should be understood that the shape of the pawl may vary to accommodate the design of the tool in which it is used and that the embodiments described herein are provided for purposes of example only.

Pawl 400 is split into two halves 414 and 416 along a line from the back of a pawl pocket 418 to a bridge 420 separating symmetric sets of pawl teeth 422 and 424 on either side of the pawl face. The cut between the two halves extends completely through the pawl, including a shelf extending rearward from a bottom area of the pawl pocket that is separated into two halves 426 and 428.

A tab extends from shelf half 428 into a corresponding grove defined in shelf half 426. The tab begins as a narrow finger and expands at its end into a circular cross-section. The tab is sized so that a small gap is left between halves 414 and 416, thereby permitting the halves to pivot slightly about the tab's circular portion. In the embodiment illustrated in FIGS. 13 and 13A, the halves may pivot by approximately ten (10) degrees. It should be understood, however, that the angle through which the halves may be allowed to pivot with respect to each other may vary and should be chosen in accordance with the design of a given tool. For example, as will become apparent below, the angle may be bounded on the high end by the shape of the back of the pawl and the shape of the pawl compartment. If the design of the pawl and/or the compartment wall is such that it is possible that the pawl's engagement with the wall could so inhibit the pawl's transition from one side of the compartment to the other, the gap between the pawl halves should be set so that the pawl halves cannot pivot to such a degree. On the low end, the pawl halves should be allowed to pivot at least such that the pawl easily disengages from the gear when transitioning from one side of the pawl compartment to the other.

The pawl halves may be allowed to pivot freely within the allowed angle. In a preferred embodiment, however, the end of the pivot tab extends upward into a cylindrical pin 430, and a spring 432 wraps around the pin so that opposing ends of the spring bias the pawl halves together. Thus, and referring to FIGS. 14A and 14C, when pawl 400 is engaged with gear 48 in one of the two wedged positions on either side of compartment 410, both sets of pawl teeth 422 and 424 engage the gear teeth.

Referring to FIG. 14C, pawl half 416 is wedged between the wall of compartment 410 and the gear and is therefore the loaded half. In this position, lever 434 is rotated so that pusher 436 engages the part of the pawl pocket at the back of half 416 so that ratcheting force is directed back through the loaded half to the pusher. As the lever is turned to transition the pawl to the other side of the compartment, the pusher's front tip moves over to half 414 and biases half 414 toward the other side of the pawl compartment and against the sides of the gear teeth. This encourages the pawl to pivot so that the teeth 422 at the leading edge of half 414 are driven into the gear teeth, while teeth 424 of the loaded side are biased way from the gear teeth. Because the pawl halves can pivot with respect to each other about pin 430 (FIG. 13), the reaction force between the gear teeth and teeth 424 on pawl half 416 causes half 416 to pivot slightly with respect to half 414, thereby facilitating disengagement of teeth 424 from the gear teeth. As half 416 moves away from the gear teeth, teeth 422 ride up the gear teeth until the pawl teeth clear the gear teeth, as shown in FIG. 14B, and the pawl transitions to the opposite wedged position shown in FIG. 14A.

Referring again to FIG. 13, the top of pin 430 is low enough so that the pusher may swing across the pawl pocket without interference from the pin. In the embodiment illustrated in FIGS. 16A–16C, the pivot pin remains below the path of the pusher (not shown) but is aligned parallel to the pawl face. More specifically, pawl 500 includes two halves 502 and 504 on which are defined symmetric sets of pawl teeth 506 and 508 that, when the pawl engages the gear, define a common radius with the gear teeth. Pawl half 502 includes a tab 514 that extends into a notch formed in half 504. Tab 514 includes a cylindrical through-hole 516 that receives a cylindrical pin 520 extending up from pawl half 504 so that the pawl halves may pivot with respect to each other about the pin. Tab 14 extends a distance from pawl half 502 so that a gap 522 between the halves permits the halves to pivot to a desired angle. A coil spring 521 wraps around pin 520 so that opposing ends of spring 521 bias the pawl halves toward the gear. The pusher tip (not shown) engages, and moves between, pawl pocket sides 510 and 512 above pin 520 and tab 514. The operation of pawl 500 in the wrench is the same as discussed above with respect to FIGS. 14A–14C.

While one or more preferred embodiments of the invention have been described above, it should be understood that any and all equivalent realizations of the present invention are included within the scope and spirit thereof. The embodiments depicted are presented by way of example only and are not intended as limitations upon the present invention. Thus, it should be understood by those of ordinary skill in this art that the present invention is not limited to these embodiments since modifications can be made. Therefore, it is contemplated that any and all such embodiments are included in the present invention as may fall within the scope of the appended claims.

What is claimed is:

1. A ratcheting tool, said ratcheting tool comprising:

a body;

a gear disposed in the body and defining a plurality of teeth on a circumference of the gear so that the gear teeth define a first arc having a first radius; and a pawl disposed in the body so that the pawl is movable laterally with respect to the gear between a first position in which the pawl is disposed between the body and the gear so that the body transmits torque through the pawl in a first rotational direction and a second position in which the pawl is disposed between the body and the gear so that the body transmits torque through the pawl in an opposite rotational direction, wherein the pawl defines a plurality of teeth facing the gear and wherein the pawl teeth define a second arc having a second radius larger than the first radius.

2. The tool as in claim 1, wherein a ratio of the first radius to the second radius is within a range from 1:1.08 to 1:1.3.

3. The tool as in claim 1, wherein the first radius extends from a center of curvature of the first arc to troughs defined between the gear teeth.

4. The tool as in claim 3, wherein the second radius extends from a center of curvature of the second arc to tips of the pawl teeth.

5. The tool as in claim 1, wherein edges of the gear teeth are substantially straight and extend between opposite axial ends of the gear in parallel with each other, and wherein edges of the pawl teeth are substantially straight and extend between opposite sides of a face of the pawl in parallel with each other and with the gear teeth edges.

6. The tool as in claim 1, wherein edges of the gear teeth extend between opposite axial ends of the gear in uniform curves extending inward from the opposite axial ends so that an outer surface of the gear defined by the teeth is concave at a center area, wherein edges of the pawl teeth extend between opposite sides of a face of the pawl in uniform curves extending away from the opposite sides so that the pawl face is convex at a center area, and wherein the pawl teeth engage the gear teeth at the center area of the pawl and the center area of the gear.

7. The tool as in claim 6, wherein a third arc extends between the opposite axial ends of the gear and is defined by the gear's concave center area, wherein a radius of a fourth arc extends between the opposite sides of the pawl face and is defined by the pawl's convex center area so that the fourth arc opposes the third arc when the gear teeth engage the pawl teeth, and wherein a radius defined by the third arc is greater than a radius defined by the fourth arc.

8. A ratcheting tool, said ratcheting tool comprising:

a body having a head and an elongated arm attached to the head;

a first compartment defined by the head;

a second compartment defined by the body and opening to the first compartment;

a gear disposed in the first compartment and defining a plurality of teeth on an outer circumference of the gear so that the gear teeth face the second compartment and so that the gear teeth define a first arc having a first radius; and a pawl disposed in the second compartment so that the pawl is slidable across the second compartment laterally with respect to the gear between a first position in which the pawl is disposed between the body and the gear so that the body transmits torque through the pawl in a first rotational direction and a second position in which the pawl is disposed between the body and the gear so that the body transmits torque through the pawl in an opposite rotational direction, wherein the pawl defines a plurality of teeth facing the gear and wherein the pawl teeth define a second arc having a second radius larger than the first radius.

9. The tool as in claim 8, including a lever disposed in the body in driving engagement with the pawl so that actuation of the lever drives the pawl between the first position and the second position.

10. The tool as in claim 8, wherein a ratio of the first radius to the second radius is within a range from 1:1.08 to 1:1.3.

11. The tool as in claim 10, wherein the ratio of the first radius to the second radius is 1:1.09.

12. The tool as in claim 10, wherein the ratio of the first radius to the second radius is 1:1.12.

13. The tool as in claim 8, wherein the gear includes a post extending axially from the gear and away from the head and wherein the post is configured to receive and retain a drive socket thereon.

14. The tool as in claim 8, wherein the gear defines a center hole about which the gear defines a plurality of flats disposed so that the gear applies rotational torque to a work piece received by the center hole and engaging the flats.

15. The tool as in claim 8, wherein the first radius extends from a center of curvature of the first arc to troughs defined between the gear teeth.

16. The tool as in claim 15, wherein the second radius extends from a center of curvature of the second arc to tips of the pawl teeth.

17. The tool as in claim 16, wherein the pawl teeth have rounded tips and wherein the second radius extends to the rounded tips.

18. The tool as in claim 16, wherein the pawl teeth have rounded tips and wherein the second radius extends to theoretical tips of the pawl teeth defined by a theoretical intersection of flat sides of the pawl teeth.

19. The tool as in claim 8, wherein edges of the gear teeth are substantially straight and extend between opposite axial ends of the gear in parallel with each other, and wherein edges of the pawl teeth are substantially straight and extend between opposite sides of a face of the pawl in parallel with each other and with the gear teeth edges.

20. The tool as in claim 8, wherein edges of the gear teeth extend between opposite axial ends of the gear in uniform curves extending inward from the opposite axial ends so that an outer surface of the gear defined by the teeth is concave at a center area, wherein edges of the pawl teeth extend between opposite sides of a face of the pawl in uniform curves extending away from the opposite sides so that the pawl face is convex at a center area, and wherein the pawl teeth engage the gear teeth at the center area of the pawl and the center area of the gear.

21. The tool as in claim 20, wherein a third arc extends between the opposite axial ends of the gear and is defined by the gear's concave center area, wherein a radius of a fourth arc extends between the opposite sides of the pawl face and is defined by the pawl's convex center area so that the fourth arc opposes the third arc when the gear teeth engage the pawl teeth, and wherein a radius defined by the third arc is greater than a radius defined by the fourth arc.

22. A ratcheting tool, said ratcheting tool comprising:

a body having a head and an elongated arm attached to the head;

a first compartment defined by the head;

a second compartment defined by the body and opening to the first compartment;

a gear disposed in the first compartment and defining a plurality of teeth on an outer circumference of the gear so that the gear teeth face the second compartment and so that the gear teeth define a first arc having a first radius;

a pawl disposed in the second compartment so that the pawl is slidable across the second compartment laterally with respect to the gear between a first position in which the pawl is disposed between the body and the gear so that the body transmits torque through the pawl in a first rotational direction and a second position in which the pawl is disposed between the body and the gear so that the body transmits torque through the pawl in an opposite rotational direction, wherein the pawl defines a plurality of teeth facing the gear, wherein the pawl teeth define a second arc having a second radius larger than the first radius, and wherein a ratio of the first radius to the second radius is within a range from 1:1.08 to 1:1.3; and a lever disposed in the body in driving engagement with the pawl so that actuation of the lever drives the pawl between the first position and the second position.

23. A ratcheting tool, said ratcheting tool comprising:

a body;

a gear disposed in the body and defining a plurality of teeth on a circumference of the gear; and a pawl defining a plurality of teeth facing the gear, wherein the pawl is disposed in the body so that the pawl is movable laterally with respect to the gear between a first position in which the pawl is disposed between the body and the gear so that the body transmits torque through the pawl in a first rotational direction and a second position in which the pawl is disposed between the body and the gear so that the body transmits torque through the pawl in an opposite rotational direction, wherein edges of the gear teeth extend between opposite axial ends of the gear in uniform curves extending inward from the opposite axial ends so that an outer surface of the gear defined by the teeth is concave at a center area, wherein edges of the pawl teeth extend between opposite sides of a face of the pawl in uniform curves extending away from the opposite sides so that the pawl face is convex at a center area, wherein the pawl teeth engage the gear teeth at the center area of the pawl and the center area of the gear, wherein a first arc extends between the opposite axial ends of the gear and is defined by the gear's concave center area, wherein a radius of a second arc extends between the opposite sides of the pawl face and is defined by the pawl's convex center area so that the second arc opposes the first arc when the gear teeth engage the pawl teeth, and wherein a radius defined by the first arc is greater than a radius defined by the second arc.

24. A ratcheting tool, said ratcheting tool comprising:

a body having a head and an elongated arm attached to the head;

a first compartment defined by the head;

a second compartment defined by the body and opening to the first compartment;

a gear disposed in the first compartment and defining a plurality of teeth on an outer circumference of the gear so that the gear teeth face the second compartment; and a pawl defining a plurality of teeth facing the gear, wherein the pawl is disposed in the second compartment so that the pawl is slidable across the second compartment laterally with respect to the gear between a first position in which the pawl is disposed between the body and the gear so that the body transmits torque through the pawl in a first rotational direction and a second position in which the pawl is disposed between the body and the gear so that the body transmits torque through the pawl in an opposite rotational direction, wherein edges of the gear teeth extend between opposite axial ends of the gear in uniform curves extending inward from the opposite axial ends so that an outer surface of the gear defined by the teeth is concave at a center area, wherein edges of the pawl teeth extend between opposite sides of a face of the pawl in uniform curves extending away from the opposite sides so that the pawl face is convex at a center area, wherein the pawl teeth engage the gear teeth at the center area of the pawl and the center area of the gear, wherein a first arc extends between the opposite axial ends of the gear and is defined by the gear's concave center area, wherein a radius of a second arc extends between the opposite sides of the pawl face and is defined by the pawl's convex center area so that the second arc opposes the first arc when the gear teeth engage the pawl teeth, and wherein a radius defined by the first arc is greater than a radius defined by the second arc.

25. A ratcheting tool, said ratcheting tool comprising:

a body;

a gear disposed in the body and defining a plurality of teeth on a circumference of the gear; and a pawl having a front side facing the gear and a back side opposite the front side, wherein the front side defines a plurality of teeth, wherein the pawl is split from the front side to the back side into two halves pivotally connected to each other, and wherein the pawl is disposed in the body so that the pawl is movable laterally with respect to the gear between a first position in which a first half of the pawl is disposed between the body and the gear so that the body transmits torque through the first half in a first rotational direction and in which a second half of the pawl is pivotable with respect to the first half away from the gear, and a second position in which the second half is disposed between the body and the gear so that the body transmits torque through the second half in an opposite rotational direction and in which the first half is pivotable with respect to the second half away from the gear.

* * * * *

UNITED STATES PATENT AND TRADEMARK OFFICE

CERTIFICATE OF CORRECTION

PATENT NO. : 6,918,323 B2 
DATED : July 19, 2005
INVENTOR(S) : Robert L. Arnold and Richard P. Folkenroth It is certified that error appears in the above-identified patent and that said Letters Patent is hereby corrected as shown below:

Column 8,
Line 15, delete "a" and replace with -- α --.

Signed and Sealed this

Seventeenth Day of January, 2006

JON W. DUDAS
*Director of the United States Patent and Trademark Office*